US006414572B2

(12) United States Patent
Satoh et al.

(10) Patent No.: US 6,414,572 B2
(45) Date of Patent: Jul. 2, 2002

(54) DIELECTRIC RESONATOR HAVING A FREQUENCY TUNING MEMBER SPIRALLY ENGAGED WITH THE CAVITY

(75) Inventors: Yuki Satoh, Katano; Masami Hatanaka, Higashiosaka; Toshio Ishizaki, Kobe; Yuji Saka, Osaka; Toshiaki Nakamura, Nara, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/798,804

(22) Filed: Mar. 1, 2001

Related U.S. Application Data

(62) Division of application No. 09/526,495, filed on Mar. 15, 2000, now Pat. No. 6,222,429, which is a division of application No. 08/891,272, filed on Jul. 10, 1997, now Pat. No. 6,107,900, which is a division of application No. 08/320,046, filed on Oct. 7, 1994, now Pat. No. 5,714,919.

(30) Foreign Application Priority Data

Oct. 12, 1993 (JP) ..... 5-254170
Nov. 2, 1993 (JP) ..... 5-274112

(51) Int. Cl.[7] ..... H01P 7/10

(52) U.S. Cl. ..... 333/235; 333/219.1; 333/231

(58) Field of Search ..... 333/202, 202 DR, 333/219.1, 235, 227, 231

(56) References Cited

U.S. PATENT DOCUMENTS

| | | | |
|---|---|---|---|
| 3,618,994 A | 11/1971 | Gepfert et al. | 403/71 |
| 4,028,652 A | 6/1977 | Wakino et al. | 333/202 |
| 4,043,692 A | 8/1977 | Hund | 403/373 |
| 4,121,181 A | 10/1978 | Nishikawa et al. | 333/202 |

(List continued on next page.)

FOREIGN PATENT DOCUMENTS

| | | |
|---|---|---|
| DE | 1275169 | 8/1968 |
| DE | 2544498 | 4/1977 |
| EP | 0501389 | 9/1992 |
| FR | 2649538 | 1/1991 |

(List continued on next page.)

OTHER PUBLICATIONS

European Search Report dated Jan. 17, 1995, for European Patent Application No. 94115968.3.

European Search Report dated Apr. 12, 1995, for European Patent Application No. 94115968.3.

(List continued on next page.)

*Primary Examiner*—Robert Pascal
*Assistant Examiner*—Barbara Summons
(74) *Attorney, Agent, or Firm*—Renner, Otto, Boisselle & Sklar

(57) ABSTRACT

A dielectric resonator of the invention includes a cavity having a first threaded hole; a dielectric block provided in the cavity; a coupling device coupled with an electromagnetic field produced in the cavity; a frequency tuning member having a screw portion which is spirally engaged with the first threaded hole of the cavity, a distance between the dielectric block and the frequency tuning member being changed by rotating the frequency tuning member, for tuning a resonance frequency of the cavity depending on the distance; and fixing means for fixing a relative positional relationship between the frequency tuning member and the cavity, wherein the fixing means prevents the frequency tuning member from rotating due to a frictional force caused between the first threaded hole of the cavity and the screw portion of the frequency tuning member, the fixing means including a lock nut having a second threaded hole which is spirally engaged with the screw portion of the frequency tuning member.

3 Claims, 27 Drawing Sheets

U.S. PATENT DOCUMENTS

| | | | | |
|---|---|---|---|---|
| 4,124,830 | A | 11/1978 | Ren | 333/209 |
| 4,477,788 | A | 10/1984 | Collinet et al. | 333/235 |
| 4,728,913 | A | 3/1988 | Ishikawa et al. | 333/235 |
| 4,862,122 | A | 8/1989 | Blair, Jr. et al. | 333/202 |
| 4,896,125 | A | 1/1990 | Blair, Jr. et al. | 333/219.1 |
| 5,051,714 | A | 9/1991 | Bentivenga et al. | 333/227 |
| 5,065,119 | A | 11/1991 | Jachowski | 333/202 |
| 5,111,170 | A | 5/1992 | Ohya | 333/219.1 |
| 5,191,304 | A | 3/1993 | Jachowski | 333/202 |
| 5,200,721 | A | 4/1993 | Mansour | 333/202 |
| 5,347,246 | A | 9/1994 | Bellows et al. | 333/219.1 |
| 5,373,270 | A | 12/1994 | Blair et al. | 333/202 |
| 5,612,655 | A | 3/1997 | Stronks et al. | 333/202 |
| 6,011,446 | A | 1/2000 | Woods | 331/185 |

FOREIGN PATENT DOCUMENTS

| | | | |
|---|---|---|---|
| GB | 1281564 | 11/1969 | |
| GB | 1520473 | 8/1978 | |
| JP | 6239902 | 2/1987 | 333/202 |
| JP | 62030404 | 2/1987 | |
| JP | 5048305 | 2/1993 | 333/202 DR |
| JP | 5183304 | 7/1993 | |
| JP | 6061713 | 3/1994 | 333/219.1 |
| RU | 1769265 | 10/1992 | |
| SU | 624325 | 8/1978 | |
| WO | 8700350 | 1/1987 | |

OTHER PUBLICATIONS

Motoo Mizumura, et al., "Oscillators Stabilized with a Dielectric Resonator in Microwave Communication Systems", Microwave and Satellite Communications Division, N.E.C. Research & Development, Jul. (1983), Tokyo, Japan, pp. 112–120.

Seymour B. Cohn, "Microwave Bandpass Filters Containing Hi–Q Dielectric Resonators", IEEE Transactions on Microwave Theory and Techniques, vol. MTT–16, No. 4, Apr. 1968, pp. 218–227.

1601
101
105
W

D
107
105
101

D
1601
105
101
1601.....Coupling Probe

DIELECTRIC RESONATOR HAVING A FREQUENCY TUNING MEMBER SPIRALLY ENGAGED WITH THE CAVITY

This is a division of application Ser. No. 09/526,495, filed Mar. 15, 2000 (now U.S. Pat. No. 6,222,429 B1) which was a division of application Ser. No. 08/891,272, filed Jul. 10, 1997 (now U.S. Pat. No. 6,107,900), which was a division of application Ser. No. 08/320,046, filed Oct. 7, 1994 (now U.S. Pat. No. 5,714,919).

BACKGROUND OF THE INVENTION

1. Field of the Invention

The present invention relates to a dielectric filter for selectively filtering a high-frequency signal having a desired frequency mainly used in a base station for a mobile communication system such as car telephones and portable telephones. More particularly, the present invention relates to a dielectric notch filter. The present invention also relates to a dielectric resonator constituting the dielectric filter.

2. Description of the Related Art

In recent years, as the development of the mobile communication system such as car telephones, a notch filter using a dielectric resonator is increasingly demanded.

Hereinafter, an exemplary conventional dielectric notch filter will be described with reference to figures. FIGS. 24A and 24B are external views of a conventional dielectric notch filter. FIG. 24A is a top view and FIG. 24B is a side view. In these figures, the dielectric notch filter includes cylindrical metal cavities 2401, a base member 2402, tuning members 2403, and input/output terminals 2404. The notch filter shown in FIG. 24 has five resonators. A transmission line is formed in the base member 2402 and electromagnetically coupled with the respective dielectric resonators, so as to constitute the notch filter. FIG. 25 shows the inside of a dielectric resonator used in the conventional dielectric notch filter shown in FIG. 24 in a simplified manner. In the metal cavity 2401, a dielectric block 2501 and a coupling loop 2502 for electromagnetic coupling are provided. FIG. 26 is a cross-sectional view showing an adjusting mechanism for adjusting the degree of electromagnetic coupling in the conventional dielectric resonator. As shown in FIG. 26, the adjusting mechanism includes a supporting member 2 for supporting the dielectric block 2501, a loop 4*a* of the coupling loop 2502, a ground part 4*b* of the coupling loop 2502, a handle 4*c* for rotating the whole coupling loop 2502, and a pole 5 of the coupling loop 2502. The pole 5 is composed of a center conductor 5*a* and an insulator 5*b*. The base member 2402 includes a transmission line 7 serving as an inner conductor and outer conductors 8. The transmission line 7 is supported by a supporting member 9 which is an insulator. In general, the dielectric block 2501 is formed integrally with and supported by the supporting member 2 using glass with a low melting point. The operation principle of the conventional dielectric resonator having the above-described construction will be described below. When the dielectric block 2501 and the coupling loop 2502 are held in the metal cavity 2401 and the transmission line 7 is connected thereto, an electromagnetic field is produced in the cavity 2401. Thus, the conventional dielectric resonator has a resonance frequency corresponding to a resonant mode. The degree of electromagnetic coupling of the dielectric resonator is a critical parameter for determining the electric characteristic of the dielectric resonator. The degree of electromagnetic coupling is determined depending on the number of lines of magnetic force across the cross section of the coupling loop 2502. That is, according to the conventional technique, the coupling loop 2502 is mechanically rotated by the handle 4*c* and hence the effective cross-sectional area is varied, so that the number of lines of magnetic force across the coupling loop 2502 is adjusted.

In order to match the impedance of the dielectric resonator, the electric length of the coupling loop is precisely adjusted to be an odd-integer multiple of a quarter wavelength.

However, the above-described prior art has the following drawbacks.

(1) A complicated mechanism for mechanically rotating the coupling loop is required, and hence the number of components required is increased.

(2) The means for impedance matching is limited, and the size of the coupling loop is greatly increased for lower frequencies. Also, since the coupling loop is small for higher frequencies, it is impossible to attain a higher degree of coupling.

(3) In principle, the range of frequencies in which the impedance matching can be achieved is narrow.

(4) In order to melt the glass for adhesion, a heating treatment to the dielectric member is required. The adhesive strength of glass is low, and the mechanical reliability is poor.

As a result, the following problems arise.

(1) The coupling loop is easily rotated due to vibration and impact, so that the degree of electromagnetic coupling is varied.

(2) The production process is complicated.

(3) The production cost is increased.

SUMMARY OF THE INVENTION

The dielectric notch filter of this invention includes: a transmission line for transmitting a high-frequency signal; an input terminal and an output terminal provided at both ends of the transmission line; a ground conductor for supplying a ground potential; and a dielectric resonator connected to the ground conductor and the transmission line, wherein the dielectric notch filter further comprises impedance matching means connected to the ground conductor and the transmission line in parallel with the dielectric resonator, and the dielectric resonator includes: a cavity connected to the ground conductor; a dielectric block provided in the cavity; a coupling device coupled with an electromagnetic field produced in the cavity; and a coupling adjusting line for connecting the coupling device to the transmission line and for adjusting the degree of electromagnetic coupling.

In one embodiment of the invention, the degree of electromagnetic coupling is adjusted by an electrical length of the coupling adjusting line.

In another embodiment of the invention, an impedance value of the impedance matching means is adjusted in accordance with an electrical length of the coupling adjusting line.

In another embodiment of the invention, the coupling adjusting line is formed of a TEM mode transmission line, and the degree of electromagnetic coupling is adjusted by a dielectric material inserted between the TEM mode transmission line and the ground conductor.

In another embodiment of the invention, the impedance matching means is an inductor. The inductor may be an air-core coil.

In another embodiment of the invention, the impedance matching means is a capacitor.

In another embodiment of the invention, the impedance matching means is a stub.

In another embodiment of the invention, the coupling adjusting line or the impedance matching means is formed by a conductor pattern provided in a dielectric substrate.

According to another aspect of the invention, the dielectric notch filter includes: a transmission line for transmitting a high-frequency signal; an input terminal and an output terminal provided at both ends of the transmission line; a ground conductor for supplying a ground potential; and a plurality of dielectric resonators connected to the ground conductor and the transmission line, wherein the dielectric notch filter further comprises a plurality of impedance matching means connected to the ground conductor and the transmission line in parallel with the plurality of dielectric resonators, and each of the dielectric resonators includes: a cavity connected to the ground conductor; a dielectric block provided in the cavity; a coupling device coupled with an electromagnetic field produced in the cavity; and a coupling adjusting line for connecting the coupling device to the transmission line and for adjusting the degree of electromagnetic coupling, resonance frequencies of the respective plurality of dielectric resonators being distributed symmetrically with respect to a filter center frequency.

In one embodiment of the invention, the plurality of dielectric resonators are first to fifth dielectric resonators, the first to fifth dielectric resonators being arranged in a direction from the input terminal to the output terminal, and the first to fifth dielectric resonators have resonance frequencies F1 to F5, respectively, the resonance frequencies F1 to F5 satisfying conditions of:

$$F4 = fo + df2$$

$$F2 = fo + df1$$

$$F1 = fo$$

$$F5 = fo - df1$$

$$F3 = fo - df2$$

where $0<df1<df2$, and fo denotes the filter center frequency.

In another embodiment of the invention, transmission lines between the first and the second dielectric resonators and between the fourth and the fifth dielectric resonators have electrical lengths larger than $\lambda/4\times(2m-1)$ and smaller than $\lambda/4\times(2m-1)+\lambda/8$, transmission lines between the second and the third dielectric resonators and between the third and the fourth dielectric resonators have electrical lengths larger than $\lambda/4\times(2m-1)-\lambda/8$ and smaller than $\lambda/4\times(2m-1)$, where $\lambda$ denotes a wavelength, and m is a natural number.

According to another aspect of the invention, a dielectric resonator is provided. The dielectric resonator includes: a cavity; a dielectric block fixed in the cavity; and a coupling device coupled with an electromagnetic field produced in the cavity, wherein a through hole is formed in the dielectric block, a fixing shaft formed of a dielectric material is allowed to pass through the through hole, and one end of the fixing shaft is fixed to the cavity by a presser member.

In one embodiment of the invention, the dielectric block resonates in a TE mode, and the through hole is provided in parallel to a propagation axis direction.

In another embodiment of the invention, the fixing shaft is threaded, and the presser member is a resin nut.

In another embodiment of the invention, the resin nut is provided with a protrusion which fits in the through hole.

In another embodiment of the invention, a resin washer having a protrusion which fits in the through hole is sandwiched between the resin nut and the dielectric block.

In another embodiment of the invention, a diameter of the through hole is larger than a diameter of the fixing shaft, and a gap is provided between the dielectric block and the fixing shaft.

In another embodiment of the invention, a supporting member having a through hole is allowed to pass through the fixing shaft, and the dielectric block is supported by the supporting member.

According to another aspect of the invention, the dielectric resonator includes: a bolt formed of a dielectric material; a bolt pressing plate having a through hole; a supporting member having a through hole; a dielectric block having a through hole; and a cavity, wherein the bolt is allowed to pass through the through holes of the bolt pressing plate, the supporting member, and the dielectric block in this order, and fastened with a nut, thereby constituting a resonator unit, the resonator unit being fixed to the cavity.

In one embodiment of the invention, a portion of the cavity at which the resonator unit is fixed has a thickness larger than a thickness of a head portion of the bolt, and an opening is provided for allowing the head portion of the bolt to pass, the opening being closed by the bolt pressing plate.

According to another aspect of the invention, the dielectric resonator includes: a dielectric block having one of a columnar shape or a cylindrical shape and having a diameter d and a height h; and a rectangular parallelepiped metal cavity having a width W, a depth D, and a height H, wherein the dielectric block is held in a center portion of the metal cavity, and a ratio of the depth D to the diameter d is in the range of 1.3 to 2.0, a ratio of the width W to the diameter d is in the range of 2.0 to 4.0, and a ratio of the width W to the depth D is in the range of 1.2 to 2.5.

In one embodiment of the invention, at least one coupling loop or at least one coupling probe is provided in the metal cavity between the dielectric block and at least one of two faces of the metal cavity defined by the width W and the height H.

In another embodiment of the invention, at least one coupling loop or at least one coupling probe is provided in the metal cavity between the dielectric block and at least one of two faces of the metal cavity defined by the depth D and the height H.

In another embodiment of the invention, the dielectric block is surrounded by a metal strap in a circumferential direction thereof, whereby the metal strap has top and bottom openings, and both ends of the metal strap are jointed by a method selected from welding, soldering, silver soldering and tabling, resulting in the metal cavity.

According to another aspect of the invention, a dielectric filter is provided in which dielectric resonators are arranged and fixed in a direction of the depth D, and the dielectric resonators are electrically connected to each other.

According to another aspect of the invention, the dielectric filter includes: N dielectric blocks each having one of a columnar shape or a cylindrical shape and having a diameter d and a height h, N being an integer of 2 or more; a single metal case having a rectangular parallelepiped shape and having a width W, a depth N×D, and a height H; and (N−1) metal partitions each having a width W and a height H, wherein the metal case is divided by the metal partitions into substantially equal portions along a direction of the depth N×D, thereby forming N rectangular parallelepiped cavities having the width W, a depth D, and the height H, and the dielectric blocks are held in the center portions of the cavities, respectively, a ratio of the depth D to the diameter d being in the range of 1.3 to 2.0, a ratio of the width W to the diameter d being in the range of 2.0 to 4.0, and a ratio of the width W to the depth D being in the range of 1.2 to 2.5.

According to another aspect of the invention, a dielectric resonator is provided. The dielectric resonator includes: a cavity having a first threaded hole; a dielectric block provided in the cavity; a coupling device coupled with an electromagnetic field produced in the cavity; a frequency tuning member having a screw portion which is spirally engaged with the first threaded hole of the cavity, a distance between the dielectric block and the frequency tuning member being changed by rotating the frequency tuning member, for tuning a resonance frequency of the cavity depending on the distance; fixing means for fixing a relative positional relationship between the frequency tuning member and the cavity, wherein the fixing means fixes the cavity and prevents the frequency tuning member from rotating due to a frictional force caused between the first threaded hole of the cavity and the screw portion of the frequency tuning member.

In one embodiment of the invention, the fixing means includes a lock nut and a fixing screw, the lock nut having a second threaded hole which is spirally engaged with the screw portion of the frequency tuning member and a through hole through which the fixing screw is passed, the cavity having a third threaded hole which is spirally engaged with the fixing screw, and the fixing means applies a force in a direction in which the lock nut and the cavity come closer to each other by tightening the fixing screw.

In another embodiment of the invention, the fixing means has a lock nut and a fixing screw, the lock nut having a fourth threaded hole which is spirally engaged with the screw portion of the frequency tuning member and a fifth threaded hole which is spirally engaged with the fixing screw, and the fixing means applies a force in a direction in which the lock nut and the cavity become are moved away from each other by tightening the fixing screw.

Thus, the invention described herein makes possible the advantages of (1) providing a dielectric notch filter having a simplified adjusting mechanism for adjusting the degree of coupling as compared with the conventional dielectric notch filter in which the degree of electromagnetic coupling is easily adjusted, (2) providing a method for supporting a sturdy dielectric block which is easily produced with lower power loss, (3) providing a compact and high-performance cavity, (4) providing a tuning mechanism which is constructed with a smaller number of components, and (5) providing steep notch filter characteristics.

These and other advantages of the present invention will become apparent to those skilled in the art upon reading and understanding the following detailed description with reference to the accompanying figures.

DESCRIPTION OF THE PREFERRED EMBODIMENTS

Hereinafter, one example of the invention will be described with reference to the accompanying drawings.

Figure 1:
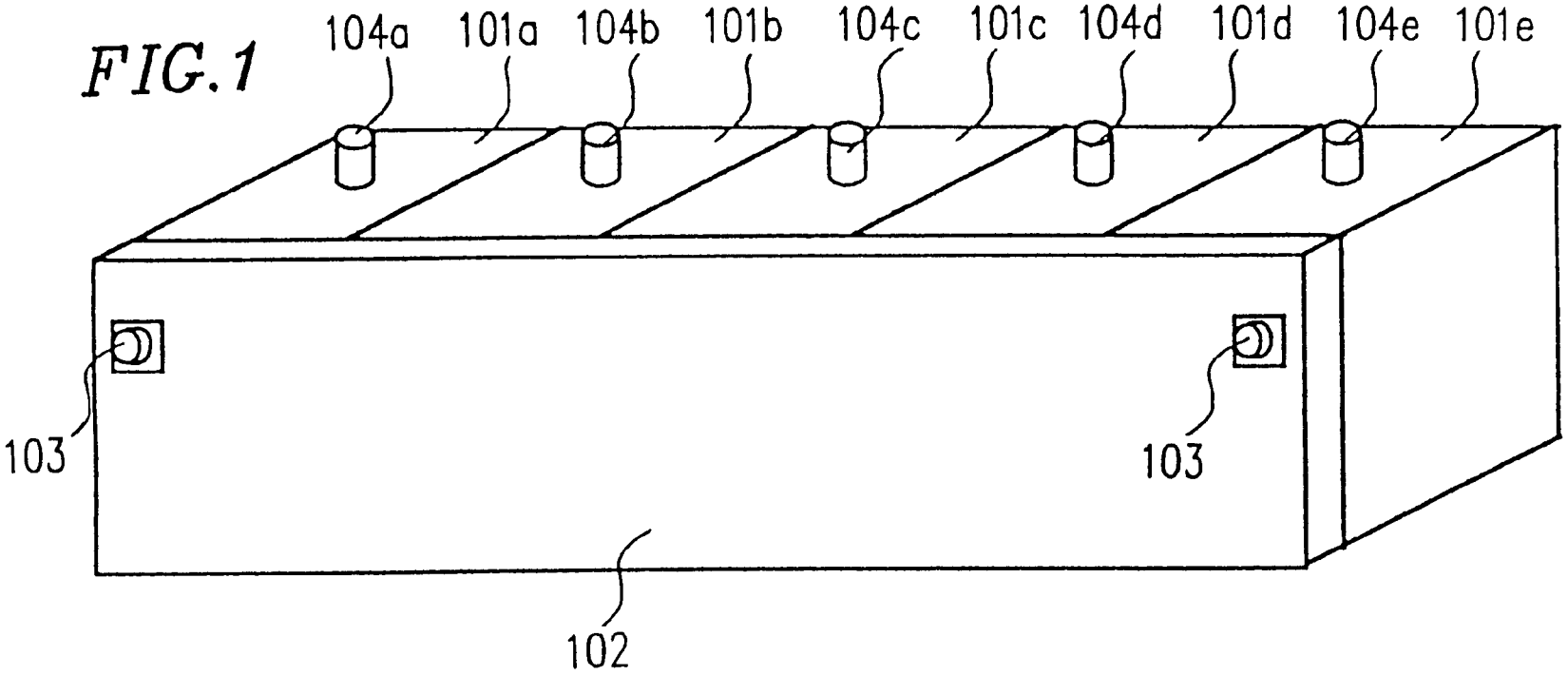
FIG. 1 is an external view of a dielectric notch filter in one example of the invention.

FIG. 1 is an external view of a dielectric notch filter in one example according to the invention. The dielectric notch filter of this example includes five dielectric resonators. Each dielectric resonator includes a box-type metal cavities

101*a*–101*e*, tuning screws 104*a*–104*e*, dielectric blocks 105*a*–105*e*, coupling loops 107*a*–107*e*, and supporting members 109*a*–109*e*. The reference numeral 102 is a housing member of a transmission line for holding an inner conductor of a transmission line therein, and input/output connectors 103 are provided on the housing member 102. The dielectric blocks 105*a*–105*e* and the coupling loops 107*a*–107*e* are provided in the metal cavities 101–101*e*, respectively.

Figure 2:
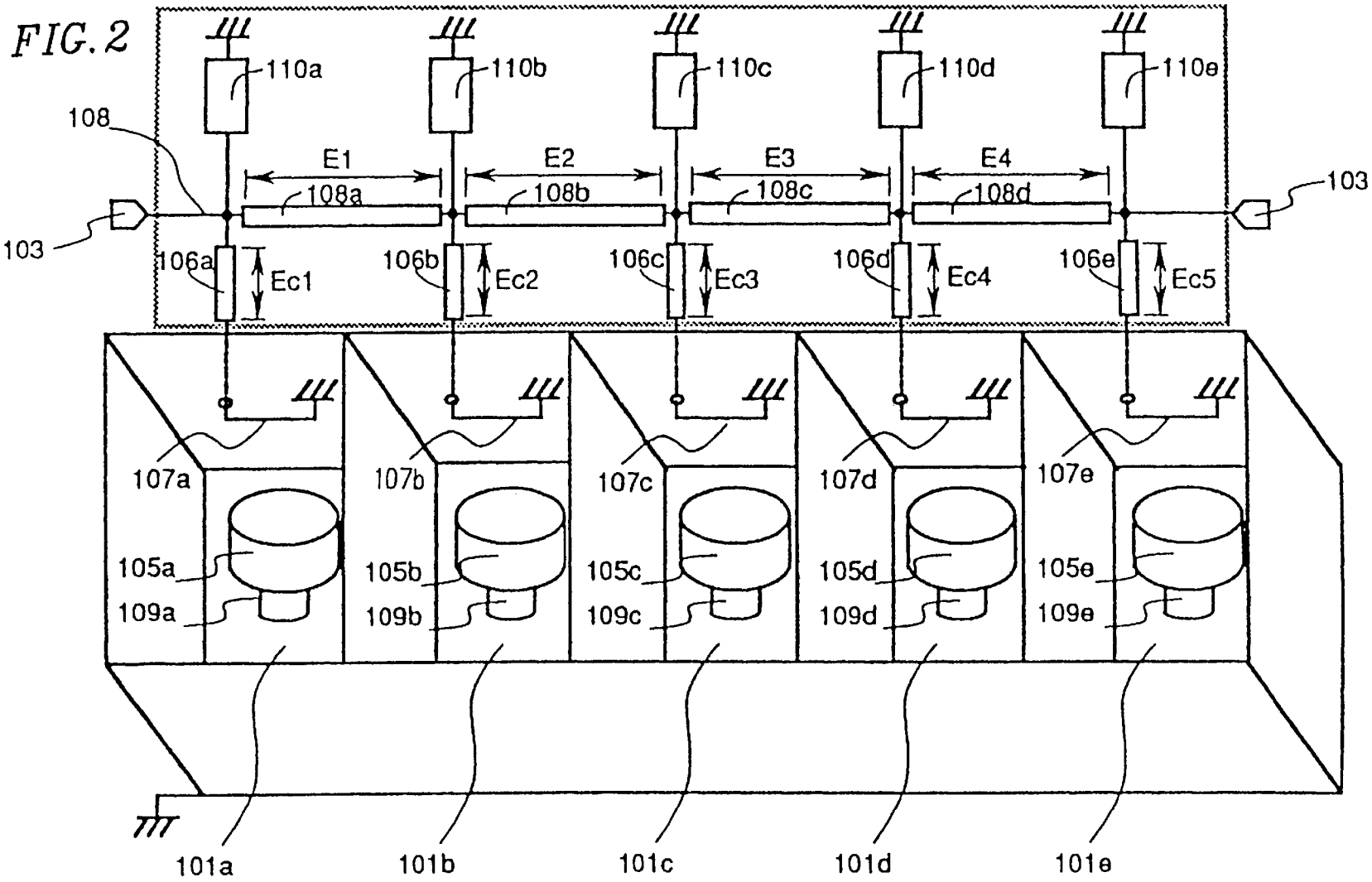
FIG. 2 is a view showing the internal construction of the dielectric notch filter in the example of the invention.

FIG. 2 shows the inside construction of the notch filter of this example shown in FIG. 1 by removing the cover portions of the metal cavities 101*a*–101*e*. FIG. 2 also shows the electric connection in the transmission-line housing member 102. In the metal cavities 101*a*–101*e*, the dielectric blocks 105*a*–105*e* supported by the supporting members 109*a*–109*e* and the coupling loops 107*a*–107*e* are provided, respectively. Respective ends of coupling adjusting lines 106*a*–106*e* having respective lengths of Ec1–Ec5 are connected to a transmission line 108. Between the points at which the transmission line 108 is connected to the coupling adjusting lines 106*a*–106*e*, transmission lines 108*a*–108*d* having respective lengths of E1–E4 are provided. The other ends of the coupling adjusting lines 106*a*–106*e* are connected to the coupling loops 107*a*–107*e* within the metal cavities 101*a*–101*e* respectively. At the points at which the transmission line 108 is connected to the coupling adjusting lines 106*a*–106*e*, reactance elements 110*a*–110*e* are connected to the coupling adjusting lines 106*a*–106*e* and the dielectric resonators, respectively, in parallel. The reactance elements 110*a*–110*e* are connected for the purpose of matching the impedances of the respective dielectric resonators. With the above-described construction, the transmission line 108 and the dielectric blocks 105*a*–105*e* are connected to each other via the electromagnetic coupling by the coupling loops 107*a*–107*e*, respectively.

Figure 3:
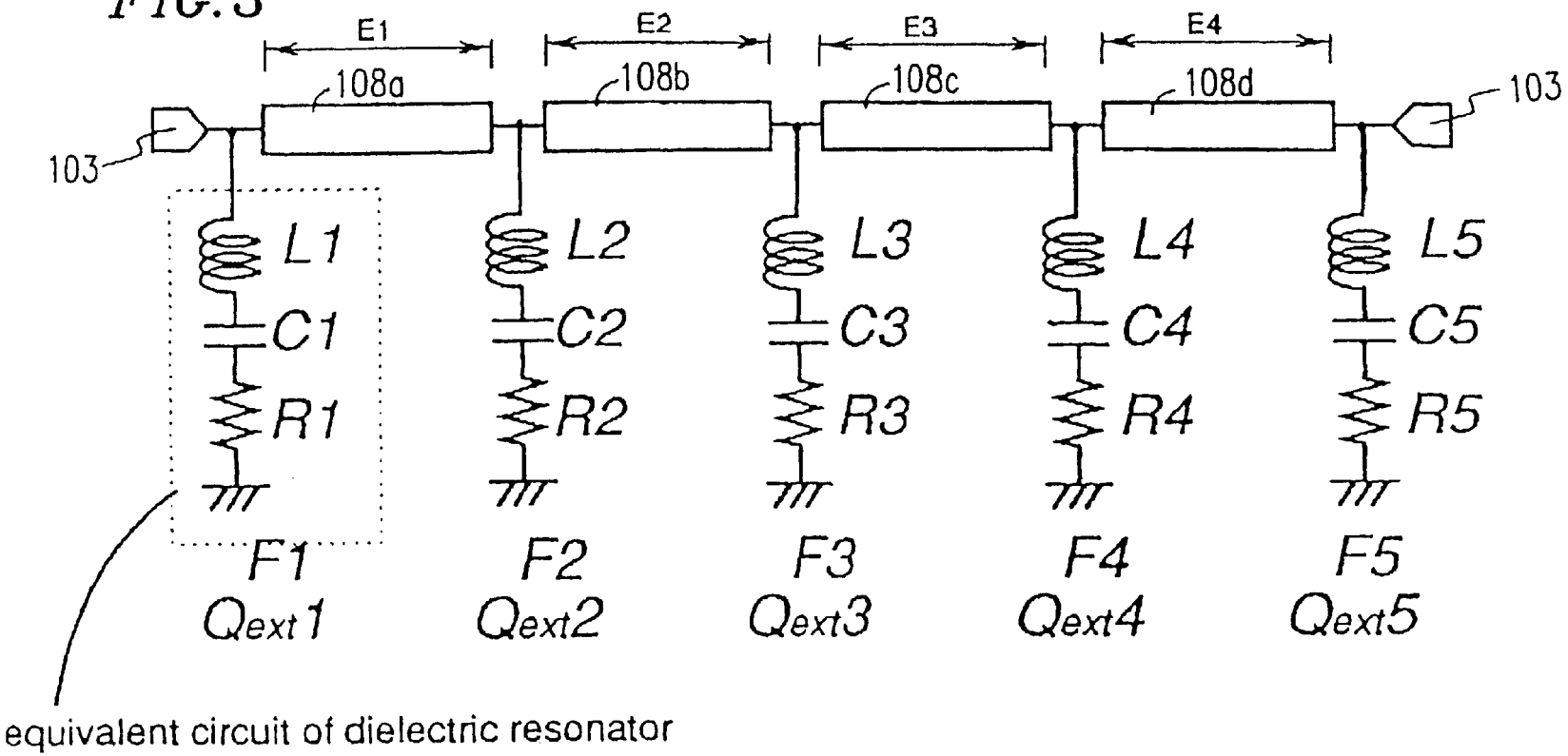
FIG. 3 is an equivalent circuit diagram of the dielectric notch filter in the example of the invention.

FIG. 3 shows the equivalent circuit of the notch filter. Each of the above-described dielectric resonators is represented as a series resonant circuit shown in FIG. 3. Thus, the dielectric notch filter of the invention functions as a band rejection filter for removing signals having a specific frequency. By changing the degree of electromagnetic coupling by the coupling loops 107*a*–107*e*, the equivalent circuit parameters (Ln, Cn, Rn; n=1, 2, 3, 4, and 5) for constituting the resonant circuit shown in FIG. 3 can be changed. By appropriately selecting the equivalent circuit parameters, and the lengths E1–E4, desired notch filter characteristics can be obtained.

One of the main features of the invention is the use of a method in which the lengths Ec1–Ec5 of the coupling adjusting lines 106*a*–106*e* and the values of the reactance elements 110*a*–110*e* are changed by adopting the coupling adjusting lines 106*a*–106*e* as a means for adjusting the degree of electromagnetic coupling of the dielectric resonator. How the equivalent circuit parameters can be adjusted by the length Ec1–Ec5 of the coupling adjusting lines 106*a*–106*e* and the reactance elements 110*a*–110*e* will be described below with reference to the relevant figures and the experimental data.

First, the function of the reactance elements 110*a*–110*e* is described. The reactance elements 110*a*–110*e* are provided for matching the impedances of the respective dielectric resonators. An ideal resonator has no reactance component at a frequency which is sufficiently separated from the resonance point. In other words, in order to allow the dielectric resonator to operate as an ideal resonator, it is necessary to cancel the reactance component at the frequency which is sufficiently separated from the resonance point. This canceling is attained by the reactance elements 110*a*–110*e*.

Figure 4:
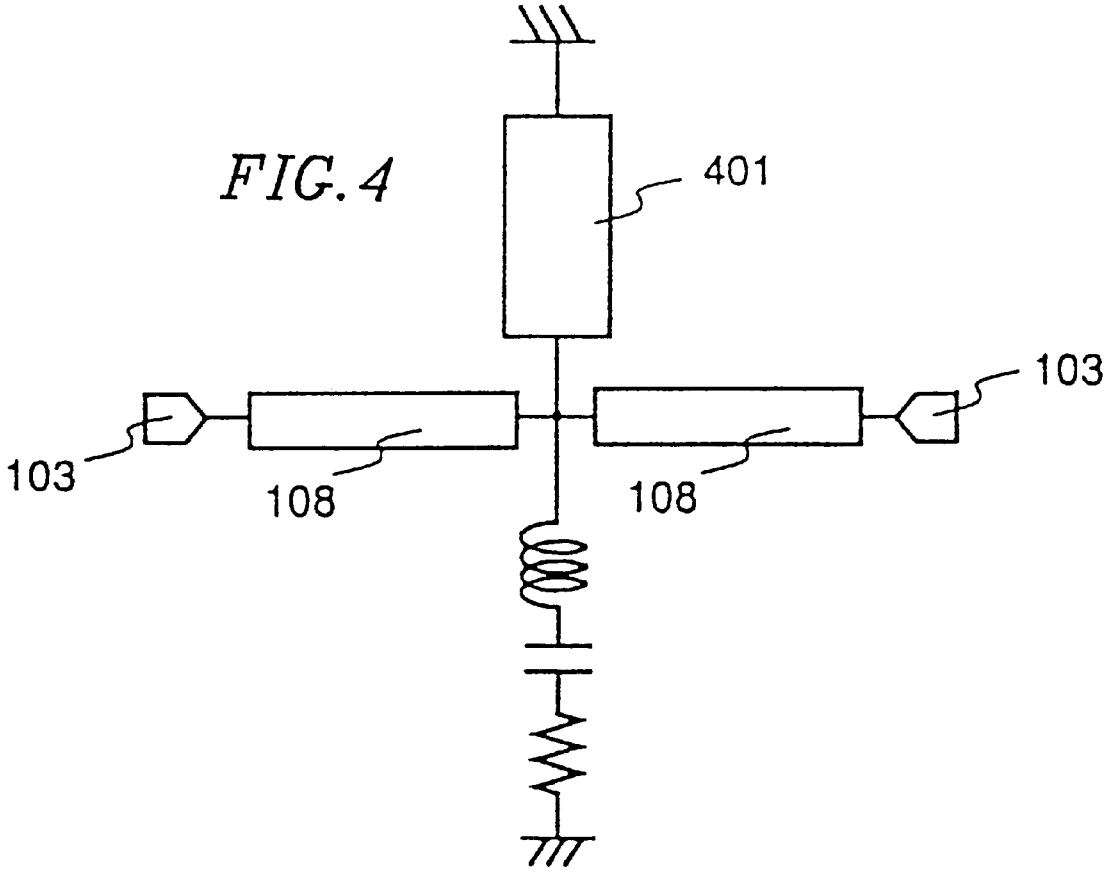
FIG. 4 is an equivalent circuit diagram in which a reactance element is connected to a series resonant circuit in parallel.
Figure 5A:
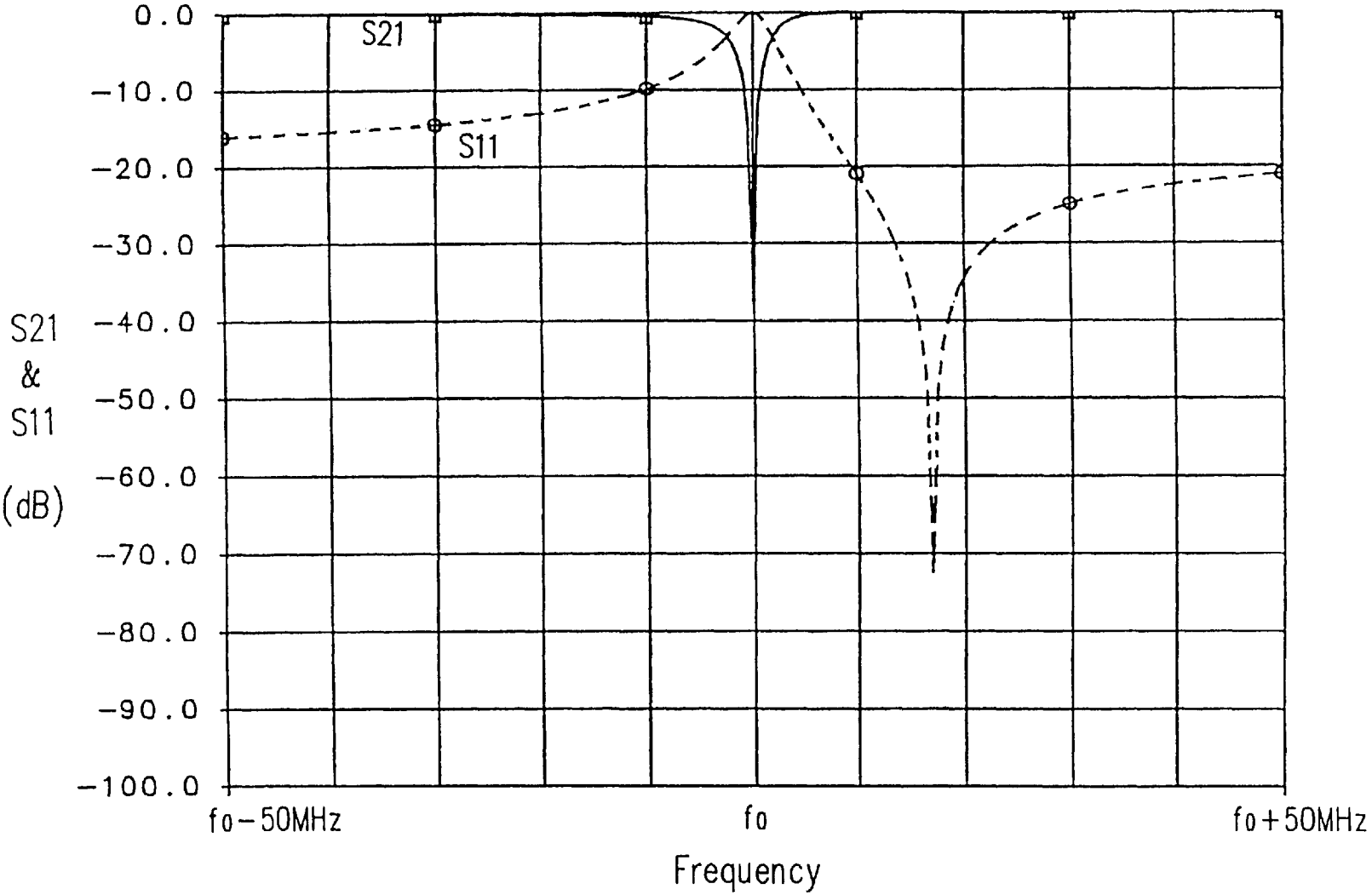
FIGS. 5A through 5C are graphs of reflection and transmission characteristics with various reactance values of the reactance element in the circuit shown in FIG. 4.
Figure 5B:
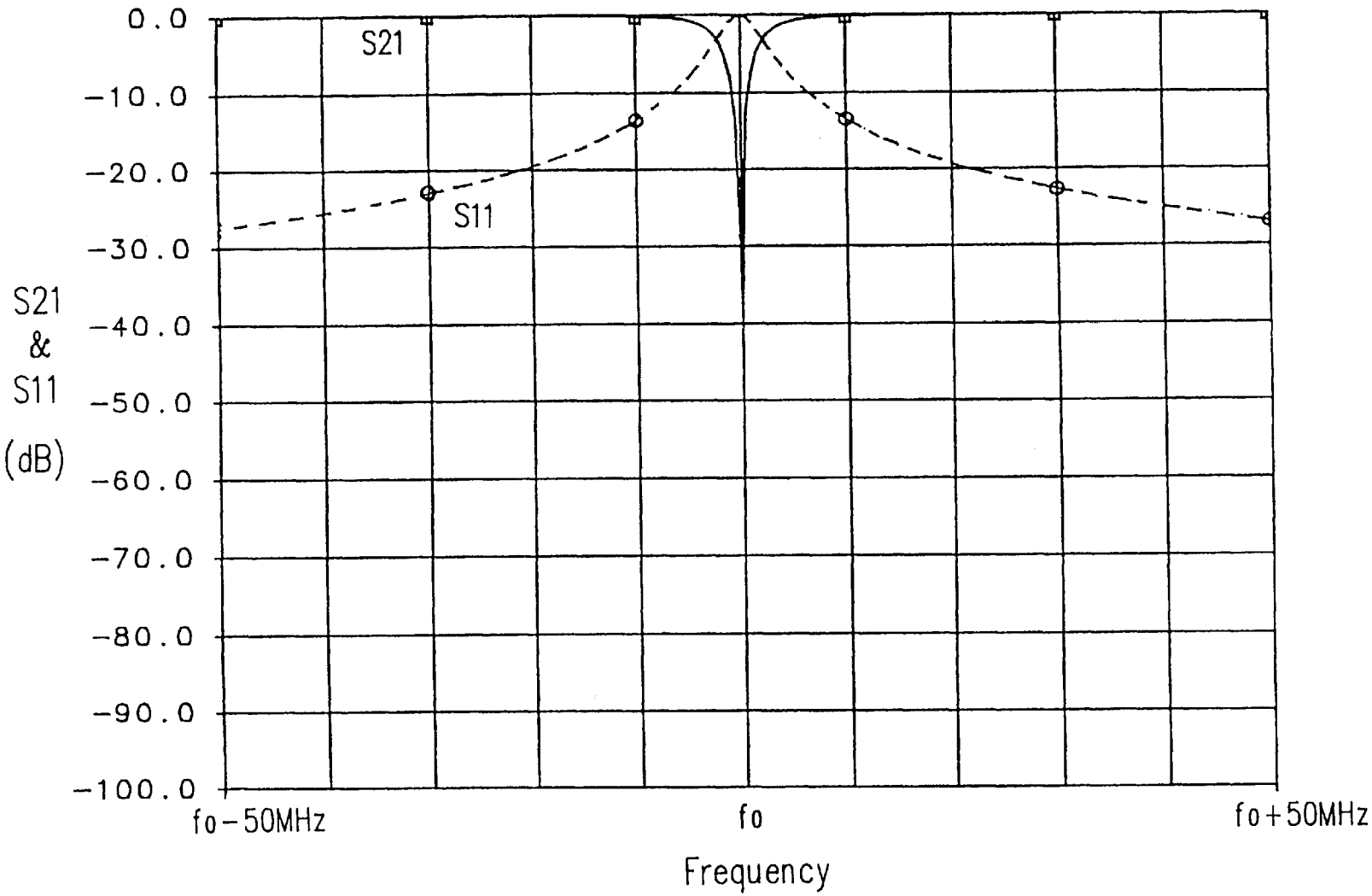
Figure 5C:
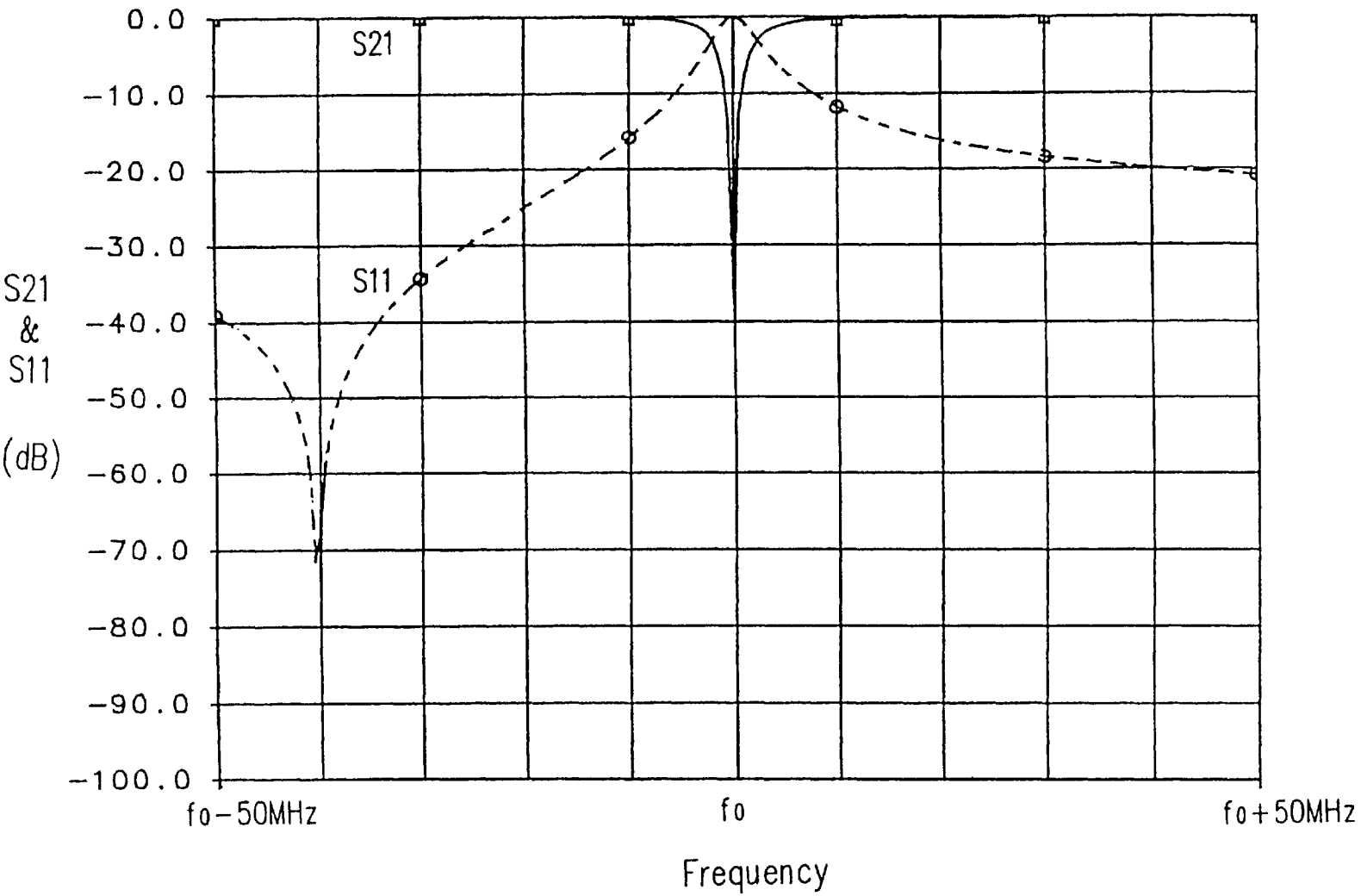

FIG. 4 shows a circuit in which a reactance element 401 is connected to a series resonant circuit in parallel. FIGS. 5A–5C show the reflection characteristic (hereinafter referred to as S11) and the transmission characteristic (hereinafter referred to as S21) when the reactance value of the reactance element 401 is changed in FIG. 4 and the impedance of the whole circuit is changed from an inductive state to a capacitive state. FIG. 5A shows the case where the dielectric resonator is inductive. FIG. 5B shows the case where the dielectric resonator is neither inductive nor capacitive, i.e., the case where the impedance is matched. FIG. 5C shows the dielectric resonator is capacitive. As shown in FIGS. 5A and 5C, when the impedance of the dielectric resonator is not matched, both S11 and S21 are asymmetric with respect to the resonance frequency, and the dielectric resonator does not operate as an ideal resonator. Accordingly, if the impedance of the dielectric resonator is inductive or capacitive (FIG. 5A or 5C), a reactance element 110 is connected in parallel to the dielectric capacitor, thereby canceling the inductive state or the capacitive state of the dielectric resonator. As a result, the state in which the impedance is matched (FIG. 5B) can be realized. In order to match the impedance of the dielectric resonator, the reactance element 110 is set to be capacitive for the inductive dielectric resonator, and the reactance element 110 is set to be inductive for the capacitive dielectric resonator.

Figure 6A:
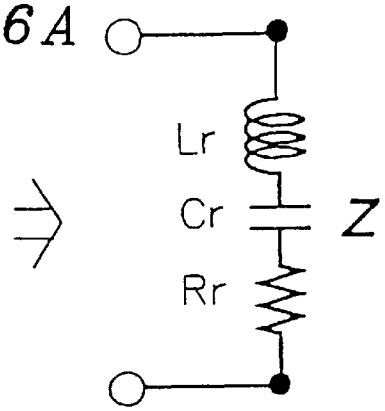
FIGS. 6A, 6B and 6C are equivalent circuit diagrams when a series resonant circuit is connected to the transmission line.
Figure 7:
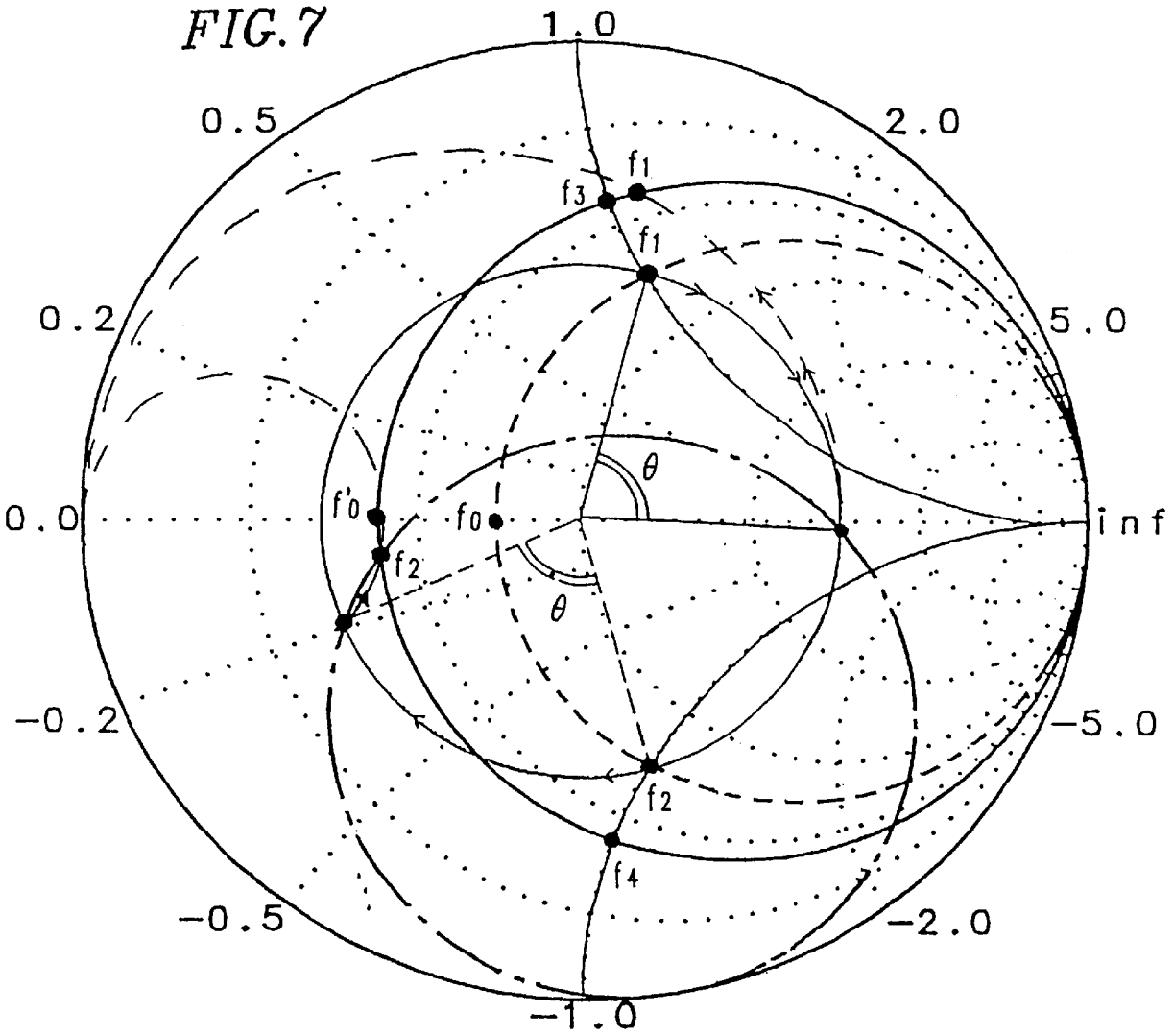
FIG. 7 is a diagram showing the frequency characteristics of the impedance of the dielectric resonator on the Smith Chart and showing frequencies for obtaining a resonance frequency and an External Q Qext.

Next, the impedance in the case where a reactance element is connected in parallel to the series resonant circuit which is connected to the transmission line will be described. For example, as shown in FIG. 6A, a series resonant circuit is connected to a transmission line having a length of zero (i.e., an electric length of zero). The frequency locus on the Smith Chart of the series resonant circuit in this case is shown in FIG. 7 by dash line. The relationship between the circuit parameters of the series resonant circuit at this time and the locus in FIG. 7 is described below. In FIG. 7, $f_0$ denotes the resonance frequency of the dielectric resonator, $f_1$ and $f_2$ denote frequencies at which the absolute value of the reactance component of the dielectric resonator is equal to an external load value. At this time, the External Q Qext of the dielectric resonator can be obtained by Expression (1) below.

$$Qext=f_0/(f_1-f_2) \tag{1}$$

The relationship between Qext and the equivalent resonant circuit constant Lr, Cr, and Rr shown in FIG. 6A can be obtained by Expression (2) below.

$$\begin{aligned} Lr &= Qext \times z_L / 2\pi f_0 \\ Cr &= 1/(2\pi f_0)^2 / Lr \\ Rr &= 2\pi f_0 Lr / Qu \end{aligned} \tag{2}$$

where $Z_L$ denotes a load impedance and Qu denotes an unloaded Q of the dielectric resonator.

As the degree of coupling of the dielectric resonator is increased, the value of $(f_1-f_2)$ is increased (i.e., the band is widened), and the value of Qext is decreased.

Figure 6B:
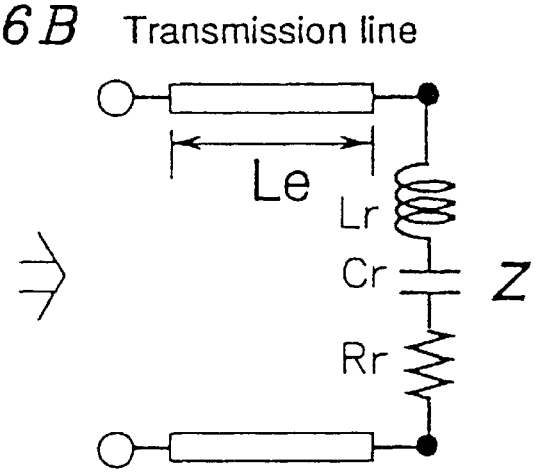
Figure 6C:
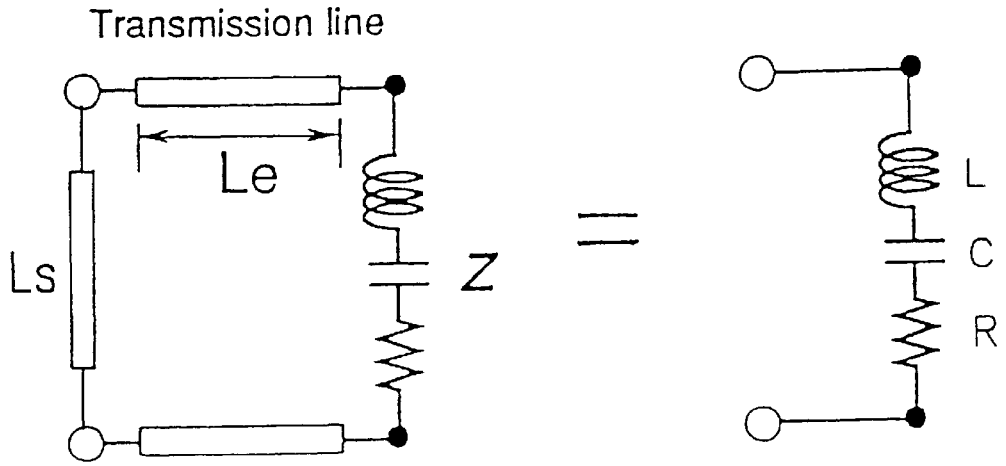

Moreover, when a transmission line having a length of Le is connected as shown in FIG. 6B, the locus is rotated by $4\pi Le/\lambda$ ($\lambda$ is a wavelength) from the locus indicated by dash line to a locus indicated by one-dot chain line on the Smith Chart shown in FIG. 7. In order to attain the impedance matching, as shown in FIG. 6C, a reactance element which is an inductor Ls in this case is connected in parallel to the series resonant circuit, the locus is moved by $(1/\omega Ls)$ on equal conductance line on the Smith Chart shown in FIG. 7, and the resultant locus is indicated by solid line. The resonance characteristics at this time are the series resonance characteristics of L, C, and R shown in FIG. 6C.

At this time, Qext' is expressed as follows:

$$Qext'=f_0'/(f_3-f_4) \quad (3)$$

where $f_0'$ denotes a resonance frequency, $f_3$ and $f_4$ are frequencies at which the absolute value of the reactance component is equal to an external load value in the resonance characteristics indicated by solid line in FIG. 7. As is seen from FIG. 7, $(f_3-f_4)$ is larger than $(f_1-f_2)$. In other words, the band in the case shown in FIG. 6C is wider than that in the case shown in FIG. 6A. As described above, the impedance of the resonant circuit can be varied. That is, if the resonant circuit is constituted by the dielectric resonator, the degree of electromagnetic coupling can be adjusted by the above-described operation.

Figure 8:
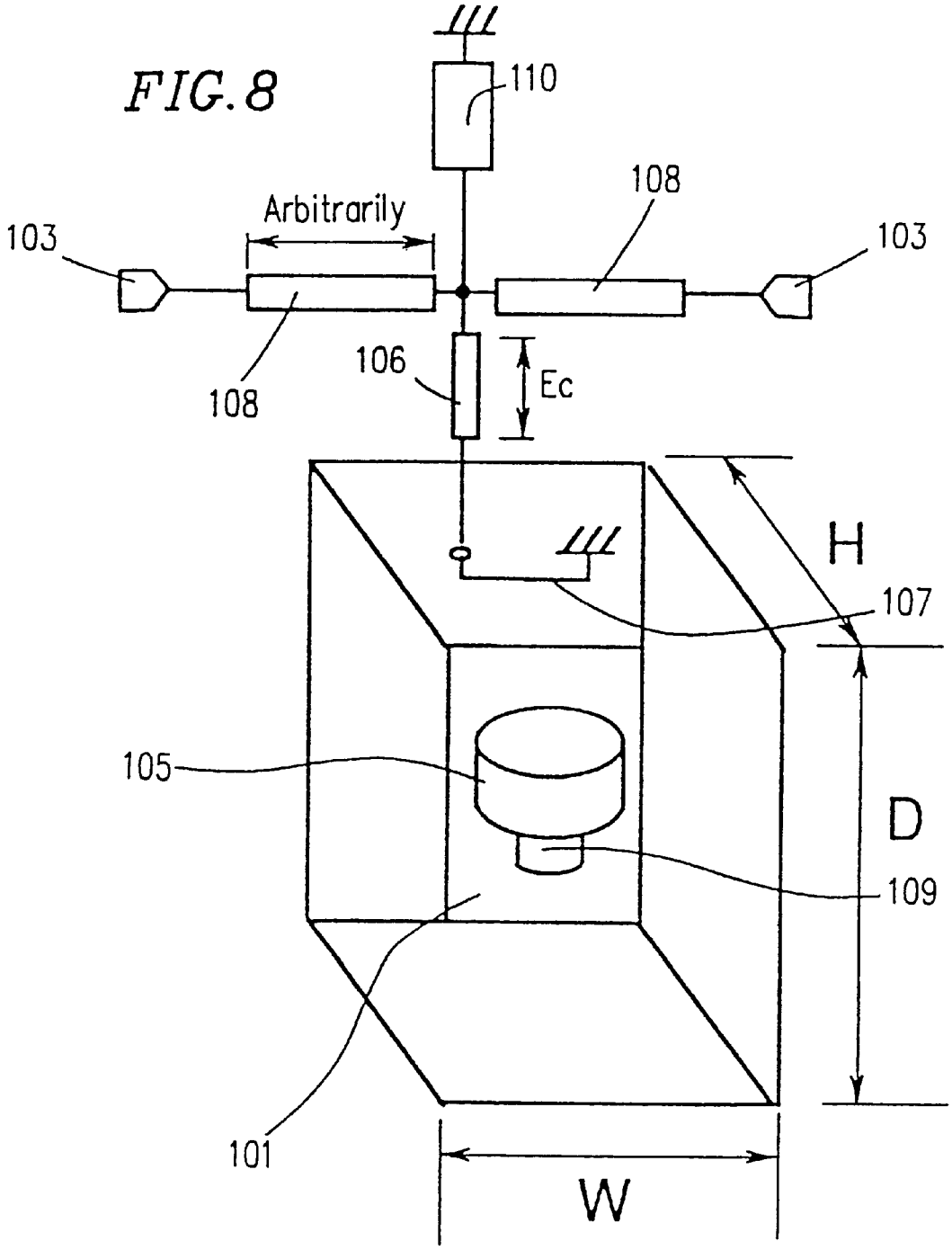
FIG. 8 is an explanatory diagram of an impedance converter.
Figure 9:
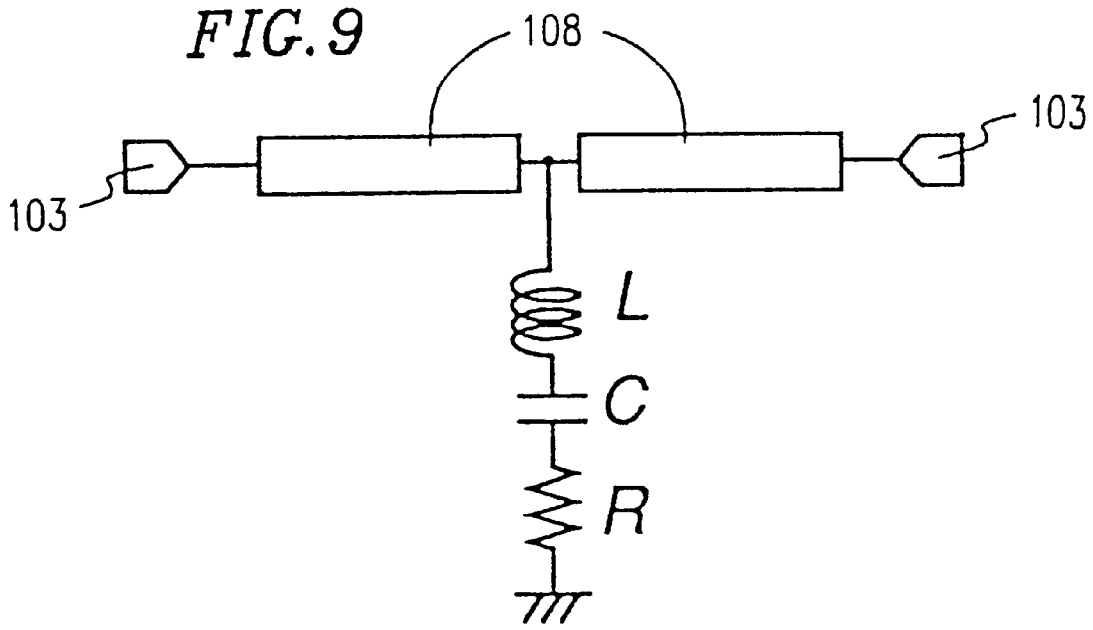
FIG. 9 is an explanatory diagram of an impedance converter.

The above-described facts are ascertained by an experiment which will be described with reference to FIGS. 8, 9, and 10. FIG. 8 shows a circuit of a dielectric resonator which is used in the experiment. The circuit corresponds to one of the five stages of the dielectric resonators in the above-described band rejection filter. Thus, the circuit is a 1-stage band rejection filter to which a transmission line 108 having a desired length and input/output connectors 103 are connected. In addition, in order to match the impedance of the dielectric resonator, a reactance element 110 is connected in parallel to the dielectric resonant at the point at which a coupling adjusting line 106 is connected to a transmission line 108. FIG. 9 shows an equivalent circuit of the dielectric resonator shown in FIG. 8. The length Ec of the employed coupling adjusting line 106 is selected to be 66, 68, 70, and 72 millimeters (mm). The employed cavity 101 has an inner size of 108 (wide)×140 (depth)×110 (height) mm. The side portion thereof is made of copper-plated iron, and the ceiling portion and the bottom portion are made of aluminum. The dielectric block 105 has an outer diameter of 62 mm, a height of 40 mm, and relative dielectric constant of 34. The dielectric block is supported by a 96% alumina supporting member 109 having an outer diameter of 35 mm, and a height of 30 mm. The coupling loop 107 has a cross section having an area of 650 $mm^2$ and is horizontally attached to the center of the side portion of the cavity 101 in the width (W) direction thereof.

Figure 10:
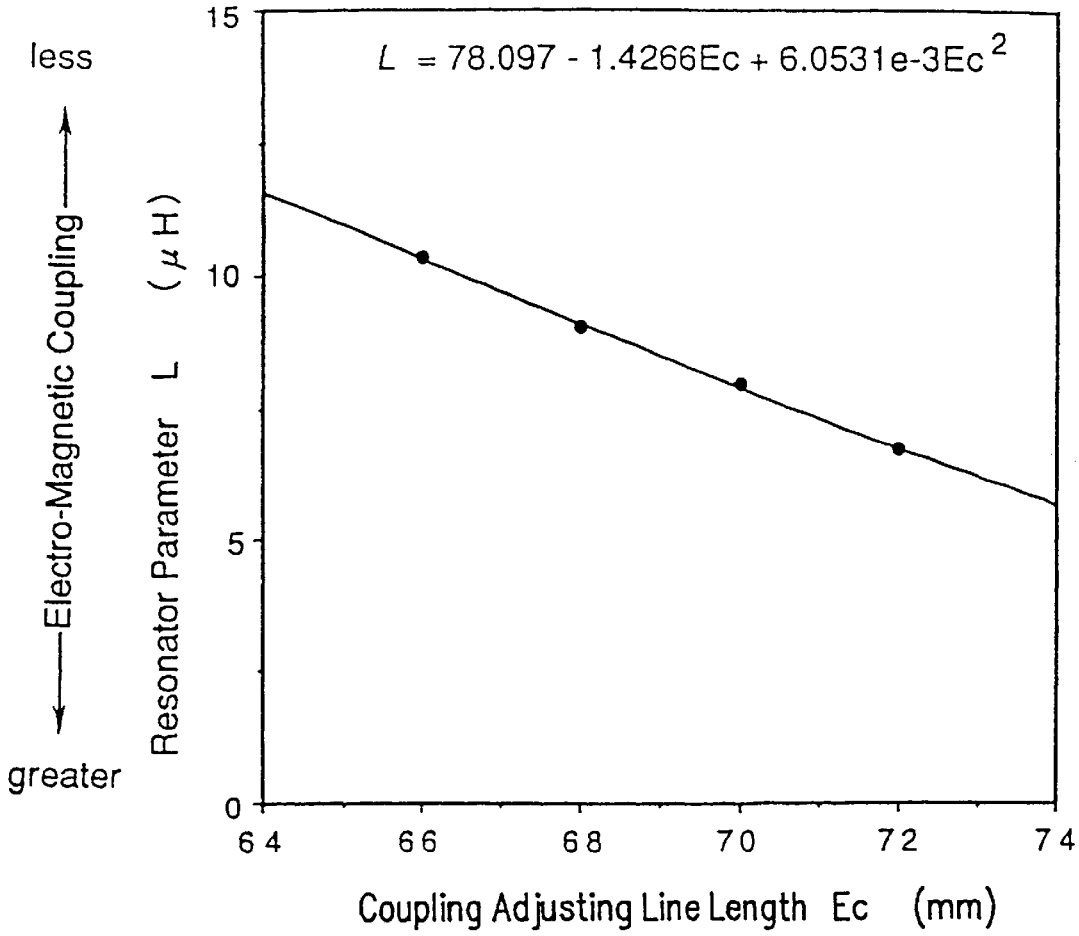
FIG. 10 shows the relationship between equivalent circuit parameter of the dielectric resonator and the coupling adjusting line length.

FIG. 10 shows the experimental result of the relationship between the inductance value L of the equivalent circuit parameter of the dielectric resonator and the length Ec of the coupling adjusting line. The vertical axis indicates the value of L, and the horizontal axis indicates Ec. Herein, the vertical axis corresponds to the degree of electromagnetic coupling of the dielectric resonator. The degree of electromagnetic coupling is increased, as the value of L is decreased. As shown in FIG. 10, it has been found that, when the length of the transmission line is changed from 66 mm to 72 mm, the value of L is changed from $10.3\times10^{-6}$ (H) to $6.7\times10^{-6}$ (H). The value of L is linearly changed with respect to the length Ec (mm) of the coupling adjusting line 106. If the value of L is more strictly approximated by a quadratic equation, it is expressed by Equation (4) below:

$$L=78.097-1.4266Ec+6.0531\times10^{-3}Ec^2(\times10^{-6}(H)) \quad (4)$$

As described above, it is experimentally ascertained that the circuit parameters of the resonant circuit can be electrically changed not by mechanically changing the effective cross-sectional area of the coupling loop but by changing the length Ec of the coupling adjusting line 106. Especially in the construction of this example shown in FIG. 2, the coupling adjusting line 106 is always required, and the coupling adjusting line 106 is positively utilized for the impedance conversion (the adjustment of the degree of electromagnetic coupling) of the dielectric resonator, which is the main feature of the invention. The relationship between L and Ec shown in Expression (4) is only an example in the case where the cavity, the coupling loop, and the dielectric block employed have the above-defined sizes. It is appreciated that if a cavity, a coupling loop and a dielectric loop having other sizes and shapes are used, it is possible to change the circuit parameters of the dielectric resonator by means of the length of the coupling adjusting line.

Figure 11:
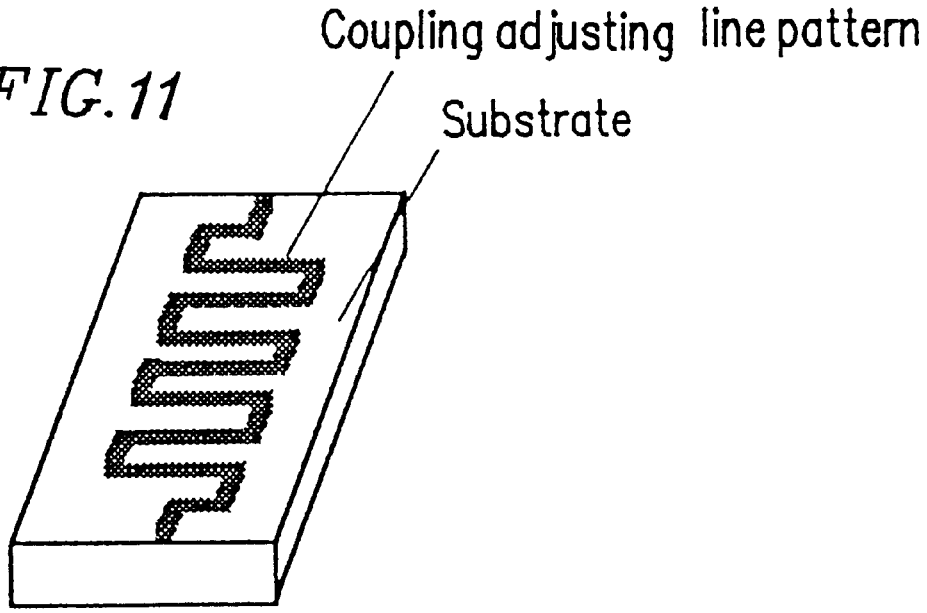
FIG. 11 is a view showing an exemplary construction of a coupling adjusting line 106 in the example of the invention.
Figure 12:
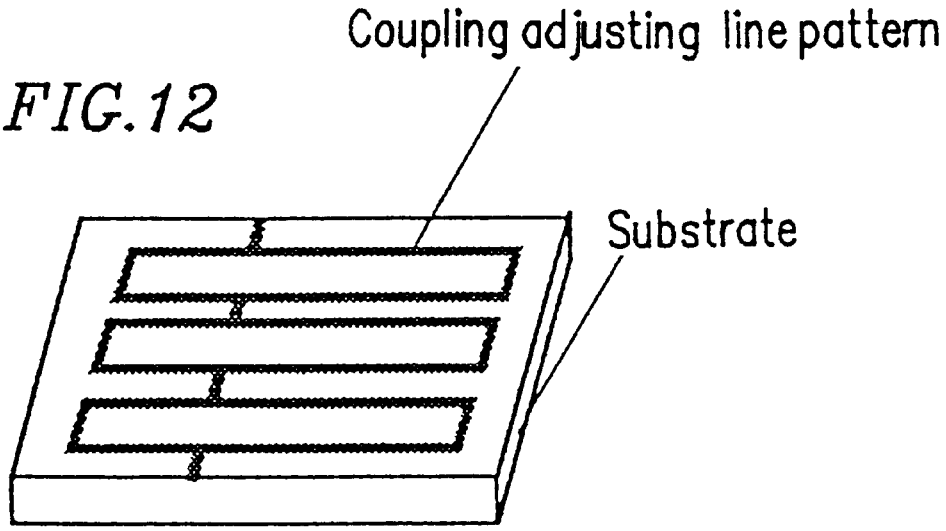
FIG. 12 is a view showing another exemplary construction of a coupling adjusting line 106 in the example of the invention.

In this example, the lengths Ec1–Ec5 of the coupling adjusting lines 106*a*–106*e* can be adjusted by the following methods. In the first method, a substrate on which a pattern such as shown in FIGS. 11 and 12 is printed can be used as the coupling adjusting line. By shaving off a part of the pattern shown in FIG. 11, the path through which the current flows is changed, and hence the electrical length is varied. In FIG. 12, a long pattern and a short pattern is connected in parallel. Therefore, in the state where the pattern is not shaved off, the current mainly flows through the short pattern. If the short pattern is cut off, the current starts to flow through the long pattern, so that the electrical length is varied. These methods attain high mechanical reliability, and can very easily change the length. As the substrate, an alumina substrate, a polytetrafluoroethylene substrate, a glass epoxy substrate, or the like is used, and the substrate has, for example, a length of 30–50 mm and a breadth of 20–30 mm. As a material of the pattern, copper or the like is used, and the width of the pattern is, for example, 5 mm.

On the substrate, in addition to the electrode pattern of the coupling adjusting lines 106*a*–106*e,* the impedance matching elements 110*a*–110*e* can be formed. In such a case, the number of components can be decreased.

Figure 13:
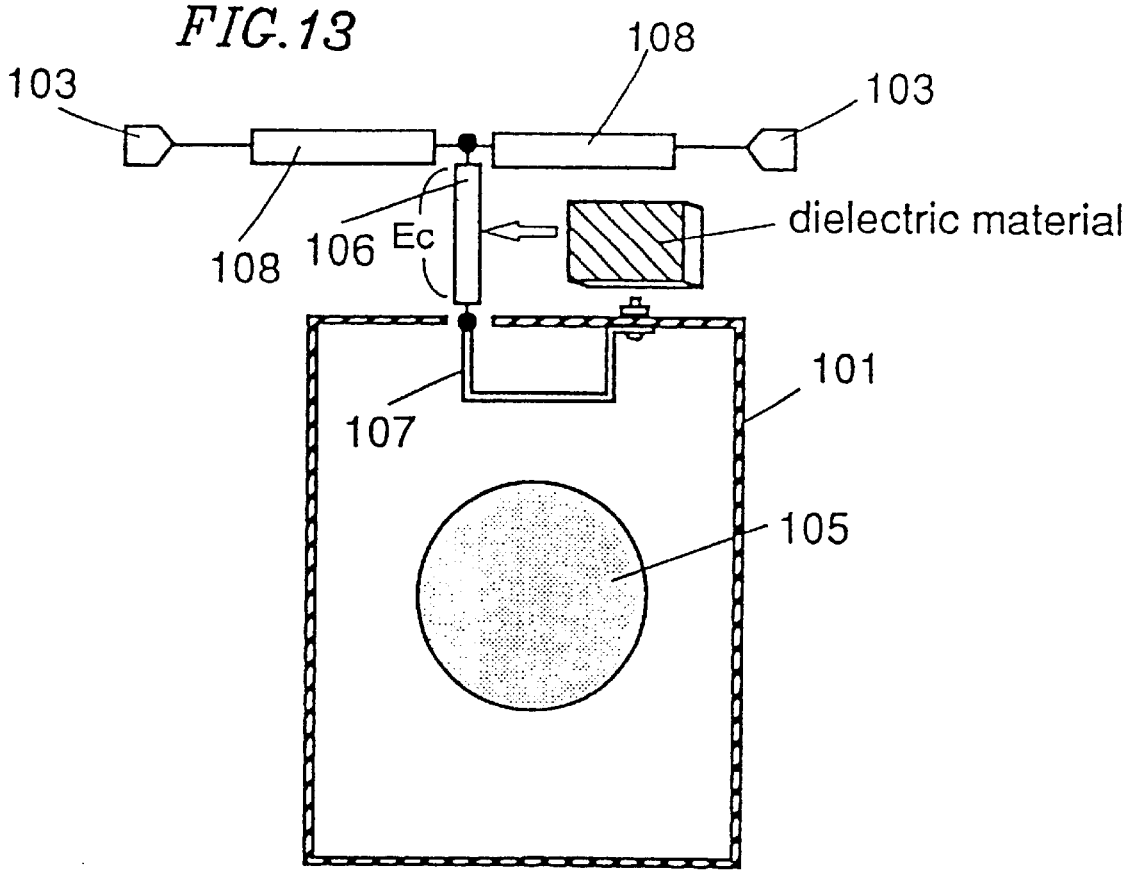
FIG. 13 is a view showing another exemplary construction of a coupling adjusting line 106 in the example of the invention.

In the second method, as shown in FIG. 13, a dielectric material is made to be closer to the conductor of the coupling adjusting line, or the dielectric material around the conductor of the coupling adjusting line is exchanged. In this case, the electrical length Ece of the line is expressed by Expression (5) using an effective dielectric constant $\in$ around the line.

$$Ece = Ec\times\varepsilon^{1/2} \quad (5)$$

Specifically, by making the dielectric material closer to the dielectric material around the transmission line, or by exchanging the dielectric material, the electrical length Ece of the transmission line can be changed. According to this method, the electrical length can be precisely adjusted without causing unwanted shavings.

What is specially noteworthy is the connecting position of the reactance element. In the cases where a notch filter is composed of two or more stages as in this example, the reactance element 110 is preferably connected at a position where the transmission line 108 and the coupling adjusting line 106 are connected. The reason is that, when viewed from the side on which the transmission line 108 is provided, the portion on the side on which the dielectric block is provided from the coupling adjusting line 106, i.e., the portion on the side on which the dielectric block is provided from the connecting point of the transmission line 108 and the coupling adjusting line 106 is regarded as a dielectric resonator. The reactance element 110 is provided for matching the impedance of the dielectric resonator. Even if the impedance is matched by connecting the reactance element 110 at a point at which the transmission line 108 and the coupling adjusting line 106 are not connected, the dielectric resonator does not operate as ideal resonator, because the dielectric resonator is not matched in view of the connecting point of the transmission line 108 and the coupling adjusting line 106. It is important to connect the transmission line 108, the coupling adjusting line 106 and the reactance element 110 at "one point". When a notch filter is constructed by using multiple stages of dielectric resonators, the lengths of transmission lines between points at which the respective dielectric resonators are connected (e.g., E1, E2, E3, and E4 in FIG. 3) function as impedance inverters, and the lengths are critical parameters for designing the notch filter. Accordingly, by connecting the reactance element 110 at a point at which the transmission line 108 and the coupling adjusting line 106 are connected, a desired impedance inverter can be realized as an electrical length between the respective points at which the transmission line 108, the coupling adjusting line 106, and the reactance element 110 are connected. As a result, the notch filter characteristics which are determined during the designing can be obtained.

As the reactance element 110, for example, an air-core coil, a capacitor having parallel plate electrodes, a transmission line stub, or the like is used. When the air-core coil is used as the reactance element 110, the impedance characteristic of the dielectric resonator can be easily adjusted by deforming the air-core coil.

In this example, the total length of the coupling adjusting line and the coupling loop can be set to be larger than a quarter wavelength or an odd-integer multiple of a quarter wavelength by one-eighth of the wavelength or less. As a result, an inductor is connected in parallel to the open end of the coupling loop, and hence the impedance of the dielectric resonator can be matched. Moreover, the method is very easily performed.

Figure 14:
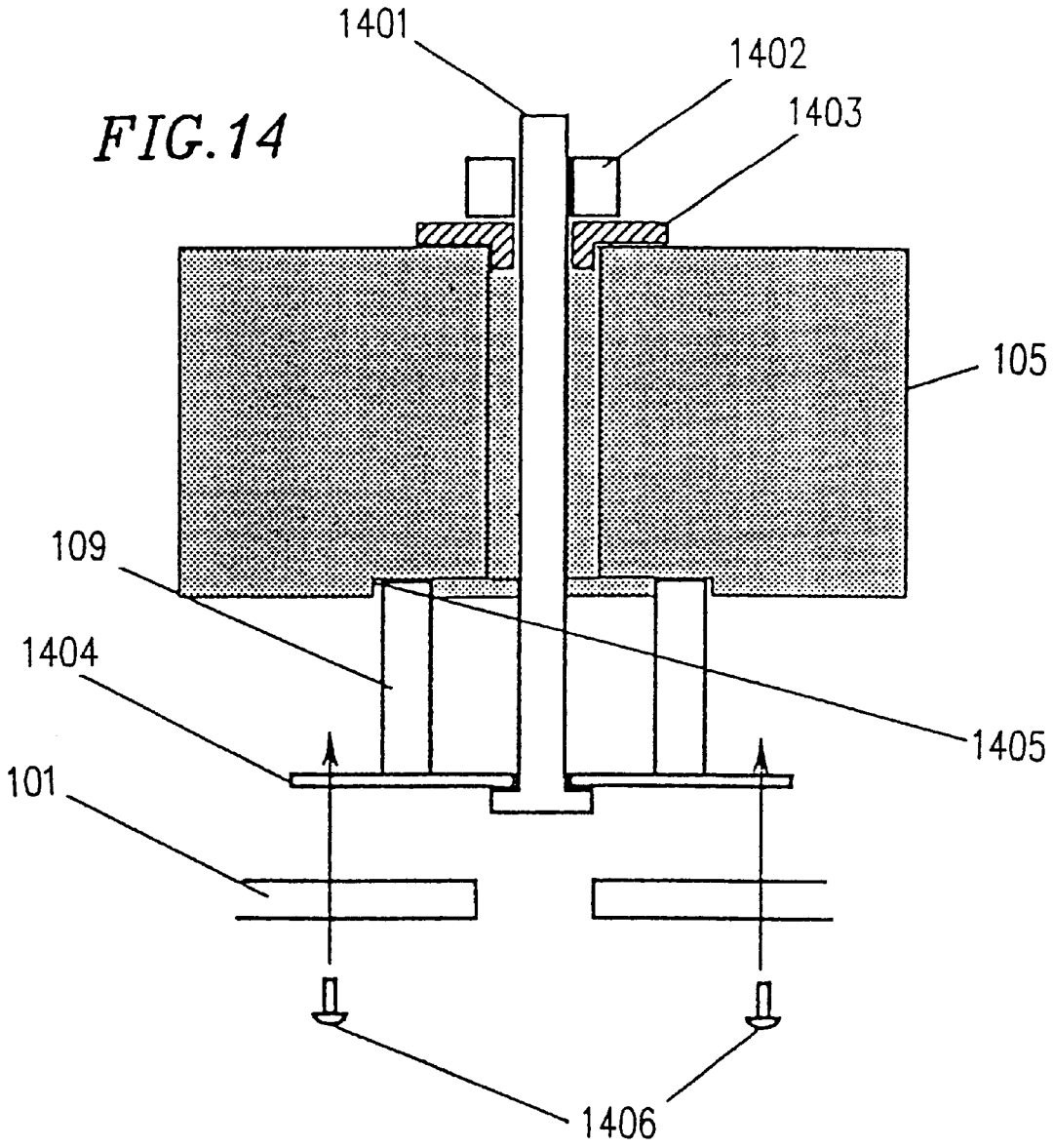
FIG. 14 is a cross-sectional view for illustrating a method for holding the dielectric block in the example of the invention.

A method for attaching the dielectric block 105 to the metal cavity 101 in this example is described next, with reference to the relevant figures. FIG. 14 shows a method for attaching the dielectric block 105 to the metal cavity 101, and shows the cross section of the cylindrical dielectric block 105 along the center axis thereof. In FIG. 14, the dielectric block 105 is supported by a cylindrical supporting member 109 which is engaged with a recessed portion 1405 of the dielectric block 105. The dielectric block 105 and the supporting member 109 are fixed to each other by a bolt 1401, a nut 1402, and a washer 1403 which are made of a resin. A bolt pressing plate 1404 has a center hole through which the bolt 1401 is attached, and the bolt pressing plate 1404 is fixed to the metal cavity 101 by means of screws 1406. The bolt 1401 passes through the bolt pressing plate 1404, the supporting member 109, the dielectric block 105, the washer 1403, and the nut 1402, in this order, so as to make them as an integral unit. The washer 1403 has a protrusion which is fitted in the through hole of the dielectric block 105 for positioning the dielectric block 105. Instead of the protrusion of the washer 1403, the nut 1402 may have a protrusion which ensures that the dielectric block 105 can be located in position. The metal cavity 101 has a hole for accommodating the head of the bolt 1401 and holes through which the screws 1406 for fixing the bolt pressing plate 1404.

With the above-described construction, it is possible to make the dielectric block 105 and the supporting member 109 into an integral unit, and the unit can easily be fixed to the metal cavity 101. According to the holding method for the dielectric block in this example, the bolt 1401 passes through the central portion of the dielectric block 105 with a lower magnetic flux density in the electromagnetic field generated in the metal cavity 101 for fixing the dielectric block 105. As a result, it is possible to increase the value of Q of the resonant circuit. As a material of the bolt 1401, the nut 1402, and the washer 1403, a material with a lower dielectric constant is preferable for increasing the value of Q. Specifically, in view of the value of Q, and the mechanical strength, polycarbonate, polystyrene, polytetrafluoroethylene, or glass-mixed materials thereof are preferably used. If the supporting member 109 is formed of a material having a relatively small dielectric constant, the magnetic flux density in the vicinity of the bottom face of the metal cavity 101 can be lowered, so that it is possible to realize a dielectric resonator having a higher value of Q. As the material of the supporting member 109, a material having a dielectric constant which is one-third of the dielectric constant (30 to 45) of the dielectric block 105, such as alumina, magnesia, forsterite (the dielectric constant thereof is about 10), or the like can be used. The metal cavity 101 has a hole for accommodating the head of the bolt 1401, and the thickness of the metal cavity 101 around the hole is set to be larger than the thickness of the head of the bolt 1401. Thus, it is possible to prevent the head of the bolt 1401 from protruding above the surface of the metal cavity 101. Due to this structure, stress can be prevented from being applied directly to the bolt during the transportation of the filter itself. As a result, it is possible to prevent the shift of the position of the dielectric block, and the physical damage of the bolt.

The recessed portion 1405 is formed on the lower face of the dielectric block 105, and the protrusion is provided on the center portion of the washer 1403, so that the positioning of the dielectric block 105 with respect to the metal cavity 101 can be easily and precisely performed. Moreover, it is possible to prevent the resonance frequency and the degree of coupling to be varied.

When an electromagnetic resonant mode of the TE mode is used, the bolt is allowed to pass through the through hole which is parallel with the propagation axis direction and is fixed by the washer and the nut, whereby it is possible to fix the dielectric block to the cavity. As a result, it is possible to minimize the deterioration of the value of Q caused by the bolt, the washer, and the nut.

Figure 15:
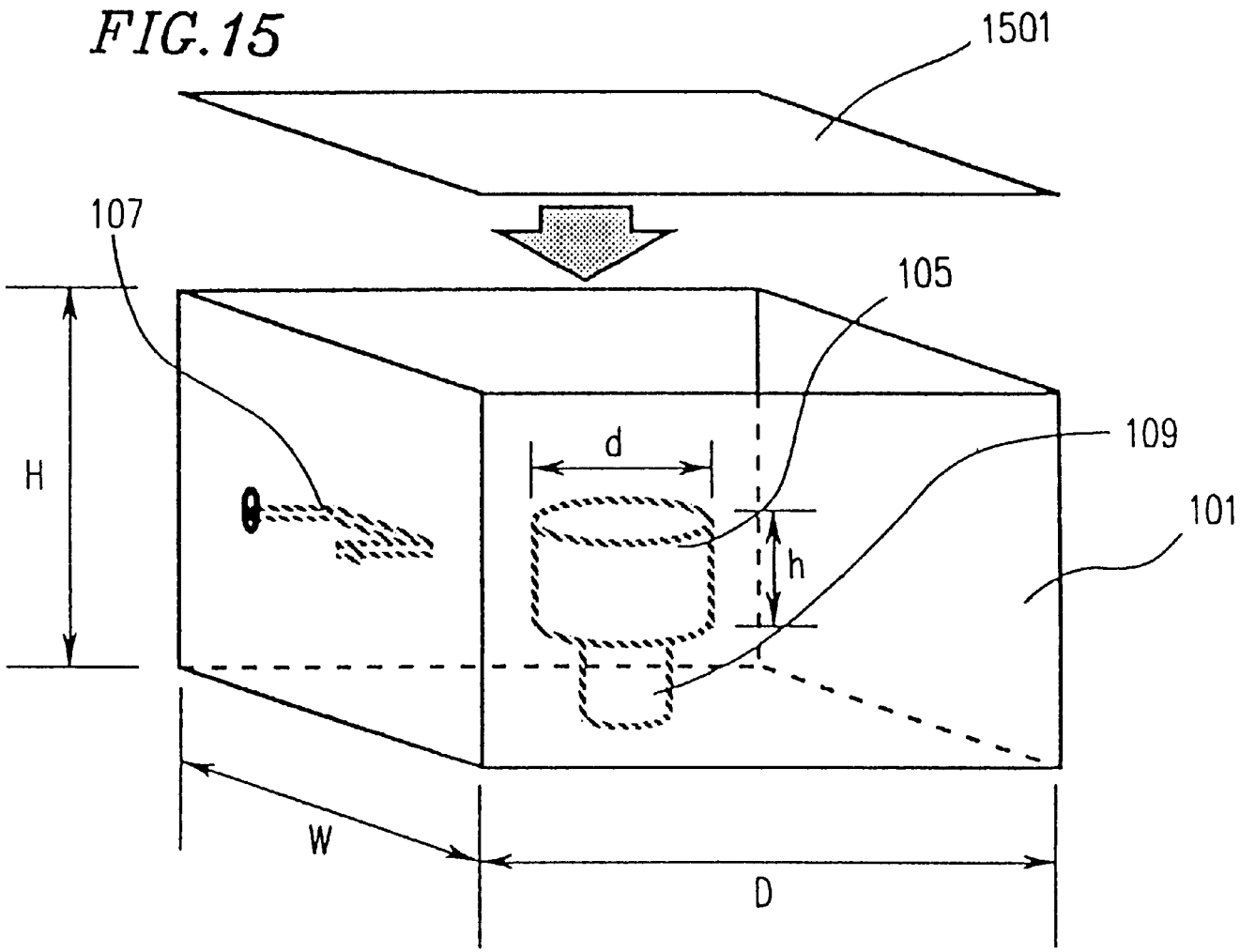
FIG. 15 is a view showing the construction of a metal cavity in the example of the invention.

The metal cavity 101 which can be used in this example will be described with reference to FIG. 15. FIG. 15 shows the shape of the metal cavity 101 and the shape of the dielectric block 105 in this example. The metal cavity 101 has a rectangular parallelepiped shape having a width (W)×a depth (D)×a height (H). The metal cavity 101 is covered with a cover 1501.

For the value of Qu for the unloaded Q, the conventional cylindrical cavity and the rectangular parallelepiped cavity in this example according to the invention are compared to each other. In order to compare the dielectric notch filter using the rectangular parallelepiped cavity in this example of the invention with the dielectric notch filter using the conventional cylindrical cavity, the actually measured results of Qu using the same dielectric block are shown in Table 1 below.

TABLE 1

| | Rectangular parallelepiped | | | | Cylinder | |
|---|---|---|---|---|---|---|
| | A | B | C | D | | |
| Cavity shape (mm) | 120 × 160 × 110 | 100 × 160 × 110 | 120 × 120 × 110 | 100 × 120 × 110 | E 140ϕ × 105 | F 100ϕ × 72 |
| Unloaded Q (measured) | 45,000 | 44,000 | 41,500 | 39,500 | 39,000 | 32,000 |

In Table 1, column A corresponds to the dielectric resonator of the invention using a rectangular parallelepiped cavity having a size of 120×160×110 mm, column B corresponds to the dielectric resonator of the invention using a rectangular parallelepiped cavity having a size of 100×160×110 mm, column C corresponds to the dielectric resonator of the invention using a rectangular parallelepiped cavity having a size of 120×120×110 mm, and column D corresponds to the dielectric resonator of the invention using a rectangular parallelepiped cavity having a size of 100×120×110 mm. Column E corresponds to the dielectric resonator using a cylindrical cavity having a size of 140ϕ×105 mm, and column F corresponds to the dielectric resonator using a cylindrical cavity having a size of 120ϕ×72 mm. The dielectric block has the specific dielectric constant of 33.4, the height (h) of 30 mm, the outer diameter (d) of 60 mmϕ, and the material Q of 53000. As is seen from the results in Table 1, the values of Qu in all of the cavities of A, B, C, and D in this example of the invention are superior to the value of Qu (39000) using the cavity of E. In terms of volume ratio, the volume ratio of the notch filter in this example of the invention is lower than and superior to that of the conventional notch filter.

The value of Q of the dielectric resonator has been hitherto considered to be determined dominantly by the wall of the metal cavity which is closest to the dielectric block, i.e., to be determined by the shortest distance between the dielectric block and the metal cavity even if the same dielectric block is used. However, if the cavity has the rectangular parallelepiped shape as shown in the example of the invention, the electromagnetic field generated in the cavity is displaced in the longitudinal direction of the cavity. Accordingly, it is found that, if the distance between the dielectric block and the cavity is shortened, the electromagnetic field escapes in the longitudinal direction, so that the deterioration of the value of Q can be suppressed.

As described above, the cavity used for the notch filter of this example can be realized in a smaller size than that of the conventional one, and can suppress the deterioration of Qu.

The shapes of the cavity shown in Table 1 are those used in the experiment. In the cavity according to the invention, the above-mentioned effects can be attained only when the rectangular parallelepiped cavity for confining the electromagnetic field has a specific size. As the results of various similar experiments, in the case where a metal cavity having a rectangular parallelepiped shape of a size of a width (W)×a depth (D)×a height (H), and a columnar or cylindrical dielectric block having a diameter (d) and a height (h) are used, the effects due to the rectangular parallelepiped cavity can be remarkably attained when the ratio of the depth (D) of the cavity to the diameter (d) of the dielectric block is set in the range of 1.3 to 2.0, the ratio of the width (W) of the cavity to the diameter (d) of the dielectric block is set in the range of 2.0 to 4.0, and the ratio of the width (W) of the cavity to the depth (D) of the cavity is set in the range of 1.2 to 2.5.

Figures 16A, 16B, 16C:
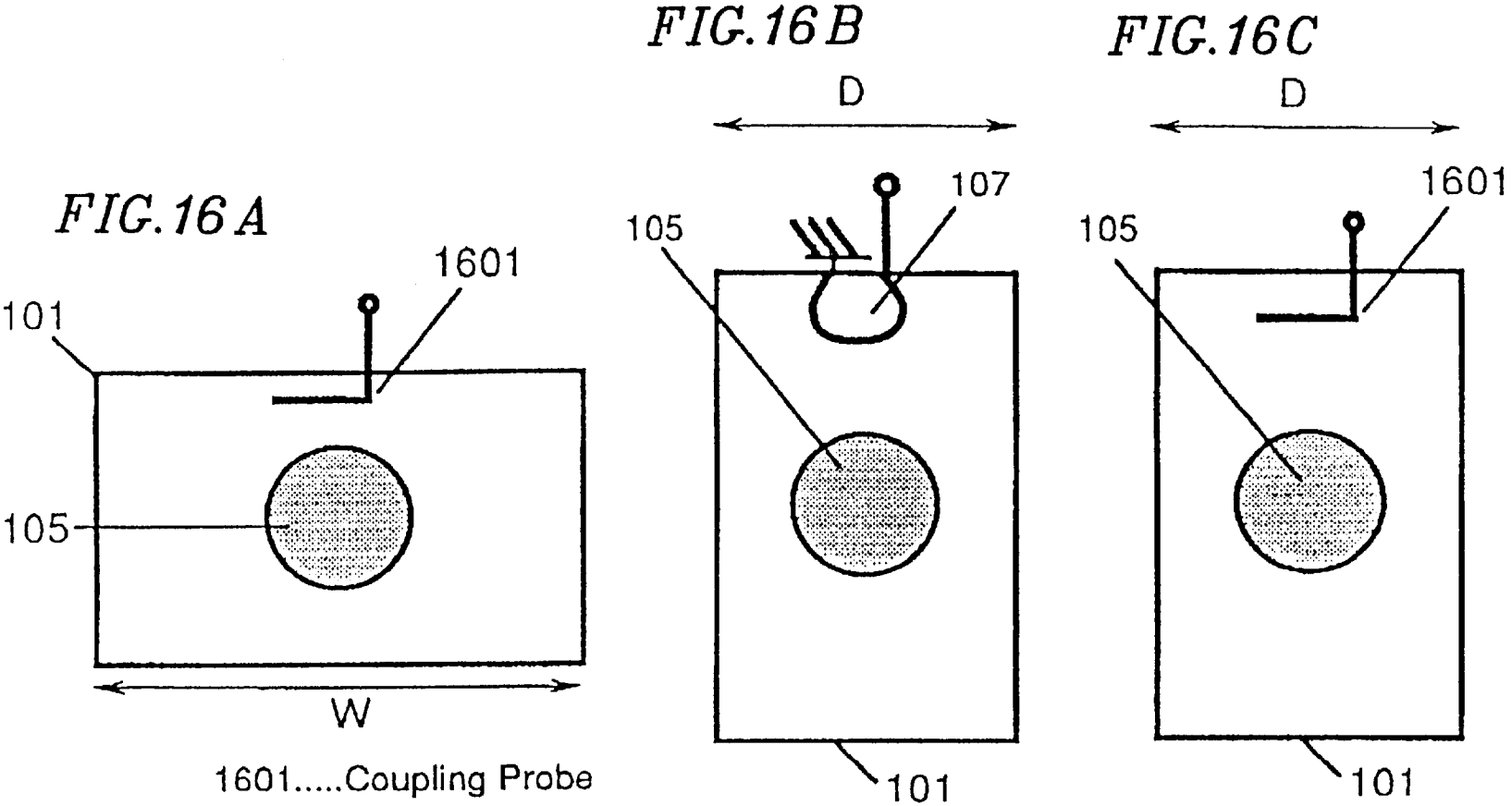
FIGS. 16A through 16C are views each showing an example of a coupling loop and a position of a coupling probe in the example of the invention.

In this example, the dielectric block 105 is electromagnetically coupled using the coupling loop 107. As for other coupling methods, the coupling using a coupling probe 1601 shown in FIGS. 16A and 16C can also be used. As shown in FIG. 16A, if the coupling loop 107 or the coupling probe 1601 is attached in the width direction (the direction indicated by W) of the metal cavity 101, the distribution of the line of magnetic force in the cavity is coupled in a relatively high density region, so that a coupling with higher density can be attained. On the other hand, as shown in FIGS. 16A and 16C, if the coupling loop 107 or the coupling probe 1601 is attached in the depth direction (the direction indicated by D) of the metal cavity 101, the distribution of lines of magnetic force in the cavity is coupled in a relatively low density region, so that the fine adjustment of the degree of coupling can be performed. When as the coupling loop 107, a metal strip having a thickness of 0.3 to 1 mm, and a width of about 3 to 8 mm is used, and the coupling loop 107 is fixed to the metal cavity 101 by means of screws, they can be tightly fixed together electrically and mechanically.

Figure 17:
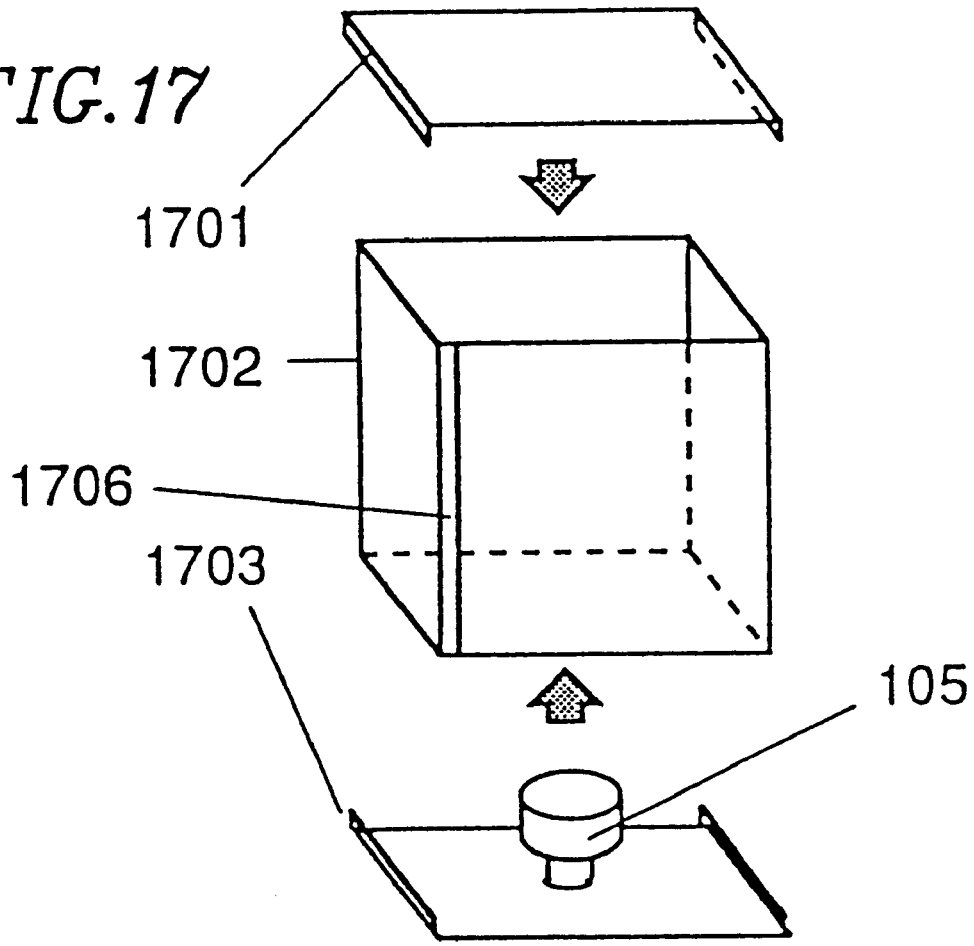
FIG. 17 is a view showing an exemplary construction of a metal cavity in the example of the invention.

FIG. 17 shows an exemplary construction of the rectangular parallelepiped metal cavity 101 of this example. In the metal cavity 101, a body member 1702 is constructed by bending a metal plate so as to have rectangular openings at the top and bottom ends thereof along the circumferential direction of the dielectric block 105. The openings of the body member 1702 are closed by a cover member 1701 and a base member 1703. It is appreciated that the metal cavity 101 does not necessarily have the components shown in FIG. 17. However, when a $TE_{01}\delta$ mode is used, an AC electric field is generated in the circumferential direction of the dielectric block 105, so that it is preferred that the construction does not prevent the AC current flowing in the circumferential direction in the metal cavity 101, in order to further increase the value of Q of the cavity. In the construction shown in FIG. 17, the body member 1702 is integrally constructed as a loop, so as to allow a current to flow in the cavity. When the body member 1702 is constructed, a joint 1706 after the bending a metal plate may be simply jointed by screws. Alternatively, they can be joined to each other by welding, soldering, silver soldering, or tabling, so that the connection resistance at the joint 1706 can be further lowered, and a resonator having a higher Q can be realized. Moreover, in FIG. 17, the cover member 1701, the body member 1702, and the base member 1703 are shown as separate members. Alternatively, for the purpose of simplifying the process, they can be formed as an integral unit. In this example, the metal cavity 101 can be, for example, made of a metal plate. If such a metal plate is used, the cavity can be more easily produced at a lower cost as compared with a conventional spinning method or the like.

Figure 18:
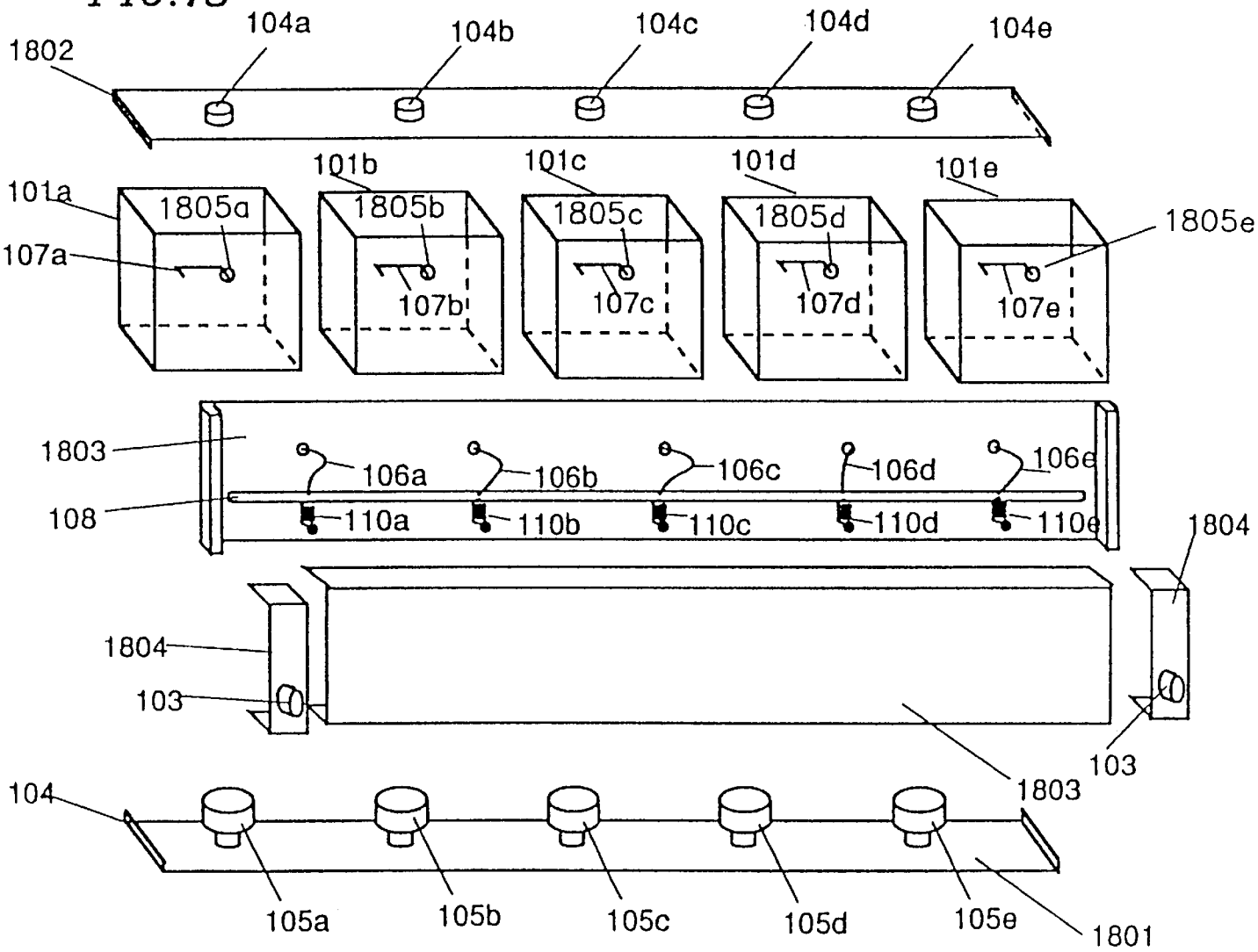
FIG. 18 is a view showing an exemplary construction of a dielectric notch filter in the example of the invention.

FIG. 18 shows a development view of the exploded construction of the dielectric notch filter in this example. In FIG. 18, the dielectric notch filter has a base member 1801 and a cover member 1802, a housing member 1803 for a transmission line 108, and a pair of connector stands 1804 for supporting the input/output connectors 103. Holes 1805*a*–1805*e* are provided in the metal cavities 101*a*–101*e*, respectively. The metal cavities 101 have respective coupling loops 107*a*–107*e* therein. One end of each of the coupling loops 107*a*–107*e* is grounded to the corresponding one of the metal cavities 101*a*–101*e*, and the other end thereof is led out through the corresponding one of the holes 1805*a*–1805*e*. Each of the metal cavities 101*a*–101*e* has rectangular openings having an aspect ratio of 1.0 to 2.0 as the top and bottom faces. The cover member 1802 has tuning members 104*a*–104*e* for the respective dielectric resonators.

The metal cavities 101*a*–101*e* each having the above-described construction are arranged in one direction, and the base member 1801 and the cover member 1802 are integrally formed so as to close the top and bottom openings of the metal cavities 101*a*–101*e*. The housing member 1803 constitutes a shielding metal for a high-frequency transmission line of triplate type, by vertically sandwiching the transmission line 108. In the housing member 1803, the transmission line 108, the coupling adjusting lines 106*a*–106*e*, and the reactance elements 101*a*–101*e* are provided. As an example of such reactance elements 101*a*–101*e*, an air-core coil with one end grounded is used in this example.

With the above-described construction, it is possible to attain the following effects using the minimum number of necessary components.

(1) It is possible to constitute a metal cavity 101 having a high value of Q for the above-described reasons.

(2) It is possible to realize a transmission line with a lower power loss.

(3) It is possible to easily adjust the inverter between resonators, by changing the point at which the coupling adjusting line 106 is connected.

(4) It is possible to constitute a dielectric notch filter which is mechanically extremely sturdy.

Figure 19:
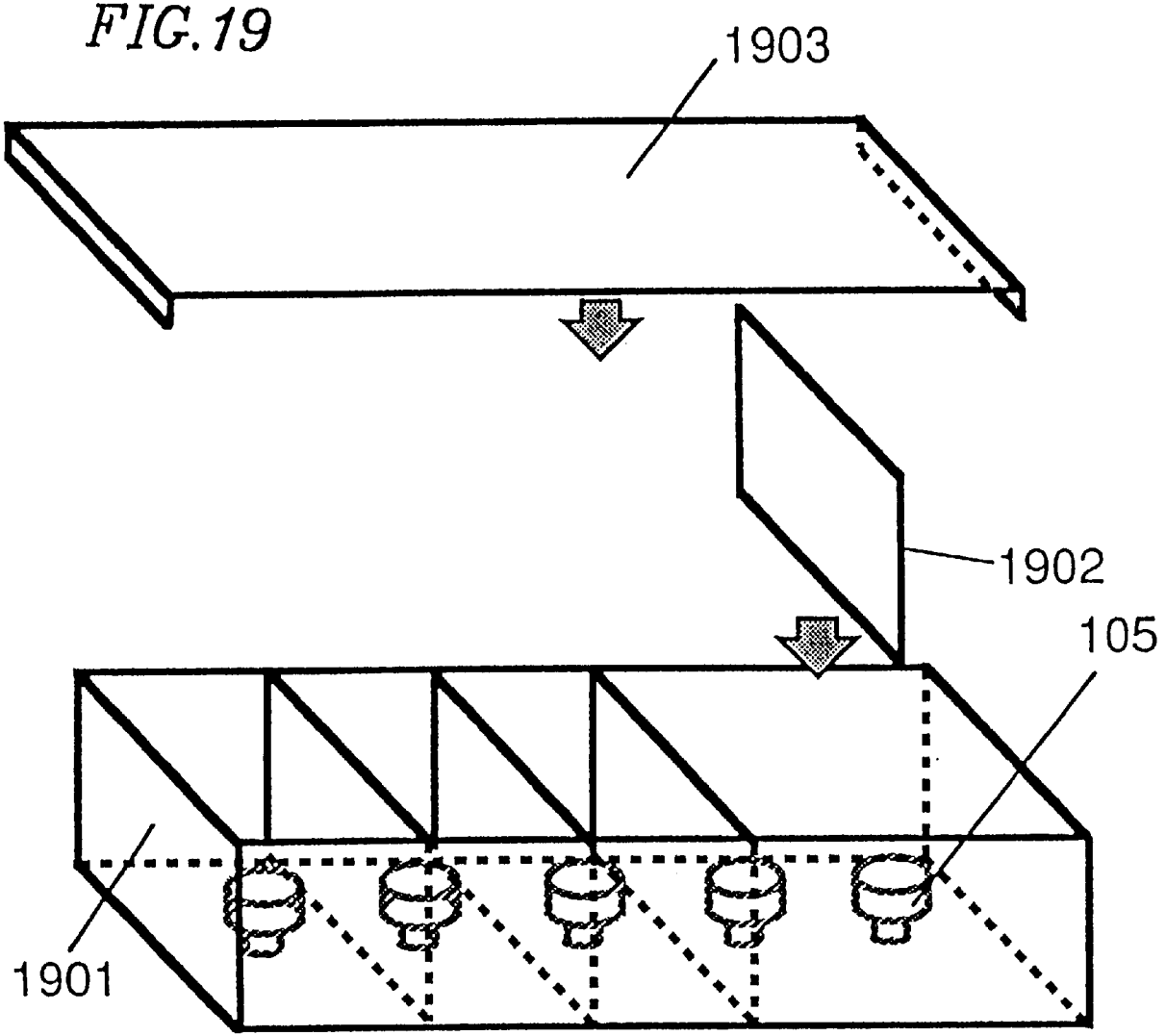
FIG. 19 is a view showing another exemplary construction of a dielectric notch filter in the example of the invention.

Instead of the construction of the metal cavity 101 shown in FIG. 18, a metal body member 1901 of a box-like shape and having a capacity of several cavities can be used and divided by partition plates 1902, and then the body member 1901 is closed by a cover member 1903 as shown in FIG. 19.

Figure 20:
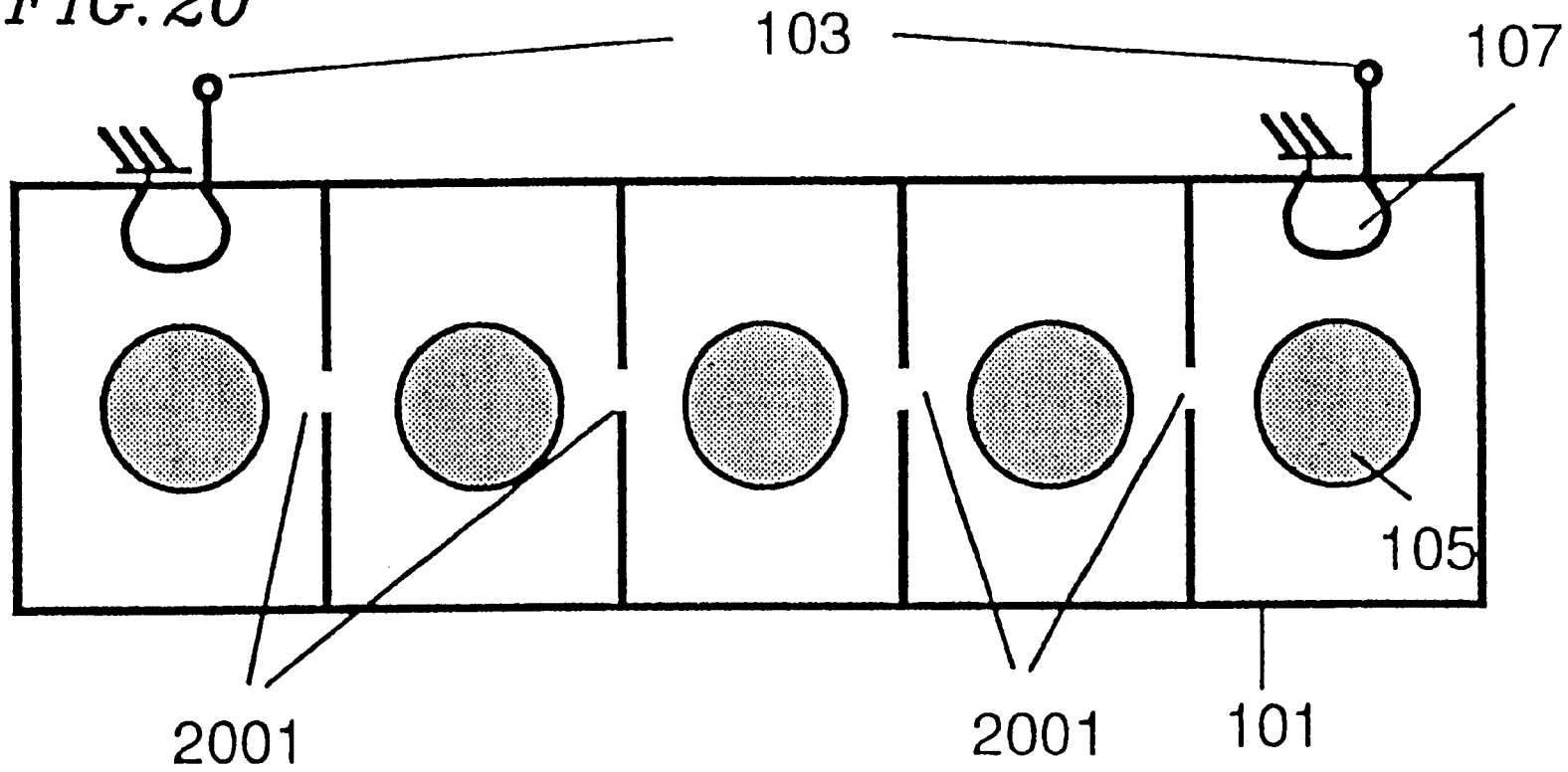
FIG. 20 is a view showing an exemplary coupling between dielectric resonators in the example of the invention, resulting in a band pass filter.

The above-described example of the invention is described for a band rejection filter. In addition, the construction of the metal cavity of the invention can be applied to a band pass filter, and the like. FIG. 20 schematically shows the construction of an exemplary band pass filter. Herein, the band pass filter includes coupling loops 107 and coupling windows 2001. As described above, the method for adjusting the degree of electromagnetic coupling of the coupling loop, the impedance matching method, and the metal cavity construction can be used, and the same effects can be attained. In this example, a tuning mechanism can be provided for the metal cavity 101.

Figure 21:
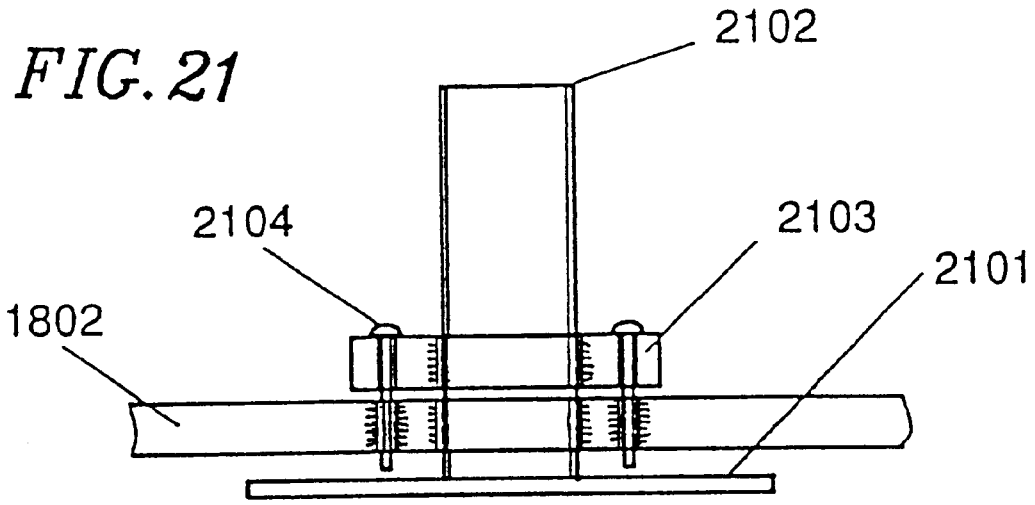
FIG. 21 is a view showing an exemplary construction of a tuning mechanism in the example of the invention.
Figure 22:
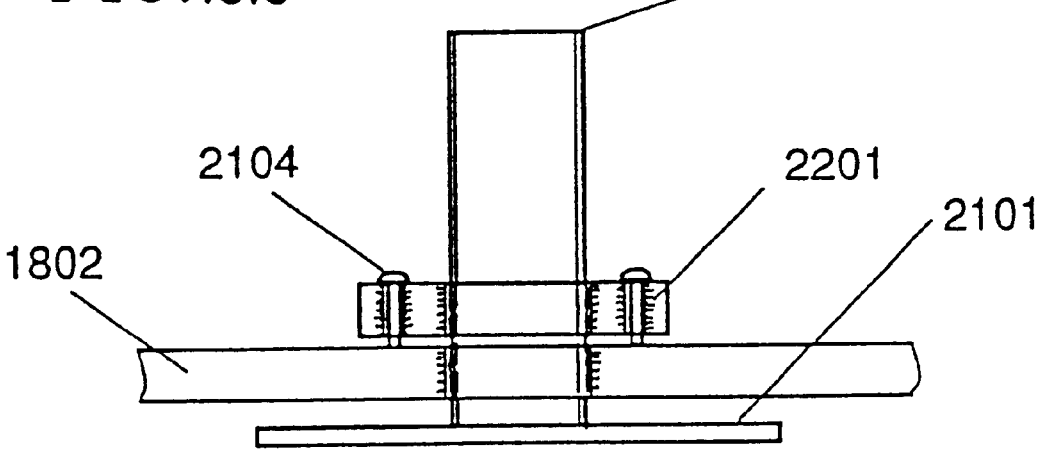
FIG. 22 is a view showing an exemplary construction of a tuning mechanism in the example of the invention.

The tuning member in this example will be described with reference to FIGS. 21 and 22. FIGS. 21 and 22 show exemplary constructions of the tuning member in this example. In FIGS. 21 and 22, a disk-like metal tuning plate 2101 is integrally formed with a tuning screw 2102. The cover member 1802, lock nuts 2103 and 2201 have threaded center openings, respectively. By rotating the tuning screw 2102, the tuning plate 2101 can be moved upwardly or downwardly. In FIG. 21, the lock nut 2103 has a through hole for allowing a screw 2104 to pass, and the cover member 1802 has a threaded hole which is spirally engaged with the screw 2104. In FIG. 22, the lock nut 2201 has a threaded hole which is spirally engaged with the screw 2104.

The construction of the tuning mechanism shown in FIG. 21 will be described. In this example, the cover member 1802 is provided with a thread at a position corresponding to the through hole in the lock nut 2103. The resonance frequency of the dielectric resonator can be adjusted by upwardly or downwardly moving the tuning plate 2101. In this example, the cover member 1802 is threaded so as to be spirally engaged with the thread of the tuning screw 2102, so that the tuning plate 2101 can be upwardly and downwardly moved by rotating the tuning screw 2102. After the frequency is tuned by the above-described method, the tuning screw 2102 is locked by the rock nut 2103. At this time, with a slight gap (in the range of 0.1 mm to 1.0 mm) between the lock nut 2103 and the cover member 1802, the through hole of the lock nut 2103 is aligned with the thread of the cover member 1802, and the screw 2104 is attached from the above of the lock nut 2103. By tightening the screw 2104, the lock nut 2103 is pressed, so that the tuning screw 2102 can be positively locked.

Another construction of the tuning mechanism shown in FIG. 22 will be described. In this example, the lock nut 2201 is threaded so as to be spirally engaged with the thread of the screw 2104. After the frequency is tuned, the screw 2104 is tightened by utilizing the thread of the lock nut 2201, so that an upward force is applied to the lock nut 2201, and hence the tuning screw 2102 can be positively locked.

As for the dielectric notch filter in this example of the invention, a method for setting circuit parameters will be described with reference to FIGS. 1, 2, and 3. The resonance frequencies of the dielectric notch filters are represented by F1 to F5 from the left side in FIGS. 2 and 3, and the values of F1 to F5 and the transmission lines 108*a*–108*d* are set as in Expression (7) below.

$$F1 = fo \tag{7}$$

$$F2 = fo + df1$$

$$F3 = fo - df2$$

$$F4 = fo + df2$$

$$F5 = fo - df1$$

$$\text{where } 0 < df1 < df2$$

The transmission lines 108*a*–108*d* operate as the impedance inverters, and the characteristics of each inverter are determined by its electrical length. In order to attain steeper selection characteristics, the electrical lengths E1–E4 of the transmission lines 108*a*–108*d* are respectively set as in Expression (8) below.

$$E1 = \lambda/4 \times (2m - 1) + de1 \tag{8}$$

$$E2 = \lambda/4 \times (2m - 1) - de2$$

$$E3 = \lambda/4 \times (2m - 1) - de3$$

$$E4 = \lambda/4 \times (2m - 1) + de4$$

where λ denotes a wavelength of a center frequency, m is a natural number, and de1 to de4 are real numbers equal to λ/8 or less.

In this way, the band rejection filter is constructed by setting the resonance frequencies so as to be symmetric with respect to the center frequency and by shifting the electric lengths of the transmission lines 108*a*–108*d* functioning as inverters by 90 degrees (λ/4). When the band rejection filter is constructed in the above-described manner, equal ripple characteristics can be obtained in the stop band in the transmission characteristics. Moreover, it is possible to generate a pole in the vicinity of the stop band in the reflection characteristics. As a result, steep filter characteristics can be obtained.

That is, the method for obtaining the steep notch filter characteristics when five stages of resonators are used is represented by Expressions (7) and (8), and the method is described below in more detail. The resonance frequency of the first-stage resonator is set to be the center frequency of the filter band, the resonance frequency of the second-stage resonator is set to be higher than the center frequency by df1, the resonance frequency of the fourth-stage resonator is set to be higher than the center frequency by df2, the resonance frequency of the fifth-stage resonator is set to be lower than the center frequency by df1, and the resonance frequency of the third-stage resonator is set to be lower than the center frequency by df2. The electrical lengths of the transmission lines between the first-stage and the second-stage resonators and between the fourth-stage and the fifth-stage resonators are set to be larger than an odd-integer multiple of λ/4 by λ/8 at the maximum. The electrical lengths of the transmission lines between the second-stage and the third-stage resonators and between the third-stage and the fourth-stage resonators are set to be smaller than an odd-integer multiple of λ/4 by λ/8 at the maximum.

For example, the designing of a band rejection filter having an attenuation center frequency of 845.75 MHz, a stop band width 1.1 MHz, and an attenuation amount of 21 dB will be shown in Expression (9).

$$F1 = 845.75\ \text{MHz} = fo \tag{9}$$

$$F2 = 846.16\ \text{MHz} = fo + df1$$

$$F3 = 845.20\ \text{MHz} = fo - df2$$

$$F4 = 846.31\ \text{MHz} = fo + df2$$

$$F5 = 845.36\ \text{MHz} = fo - df1$$

where $df1 = 0.40 \pm 0.02$ MHz and $$df2 = 0.55 \pm 0.02\ \text{MHz},\ Qext1 = 1263$$

$$Qext2 = 1235$$

$$Qext3 = 1752$$

$$Qext4 = 3493$$

$$Qext5 = 2046$$

$$E1 = 117\ \text{degrees} = \lambda/4 + 3/40$$

$$E2 = 75\ \text{degrees} = \lambda/4 - \lambda/24$$

$$E3 = 83\ \text{degrees} = \lambda/4 - 7/360$$

$$E4 = 130\ \text{degrees} = \lambda/4 + \lambda/9$$

where λ denotes a wavelength of a center frequency.

Figure 23A:
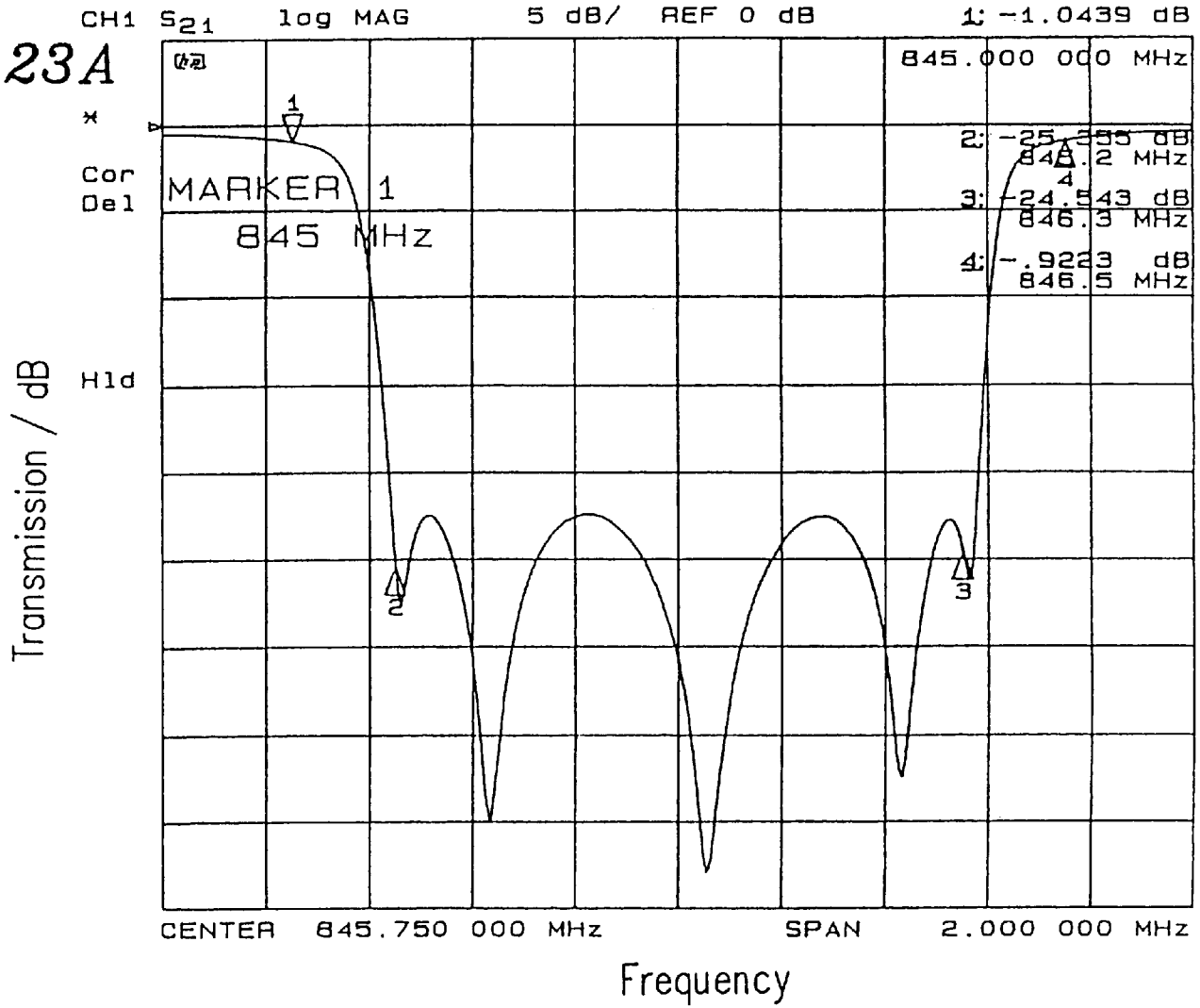
FIGS. 23A and 23B are graphs illustrating a transmission characteristic and a reflection characteristic, respectively, of the filter characteristics of the dielectric notch filter in the example of the invention.
Figure 23B:
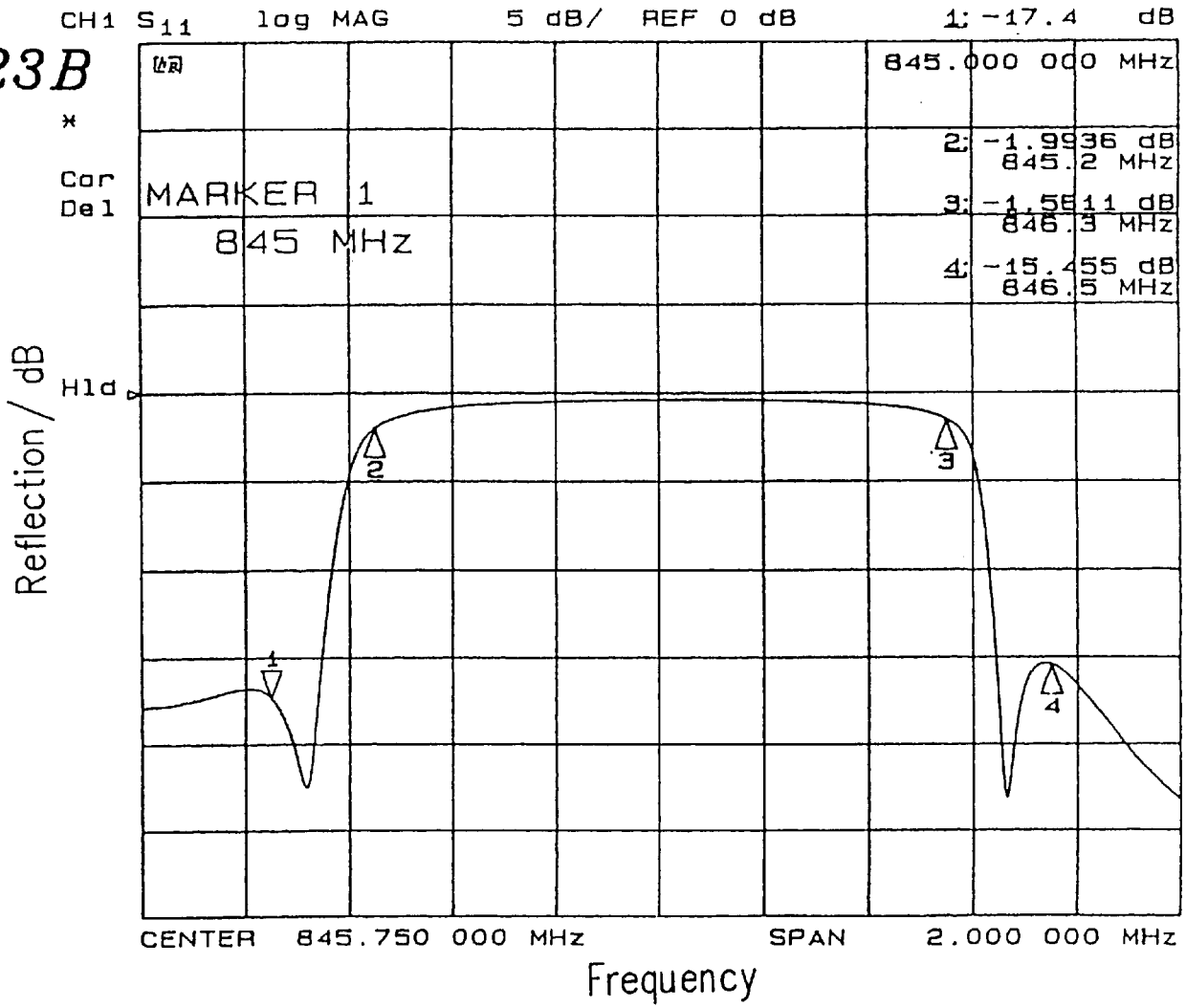
Figure 24A:
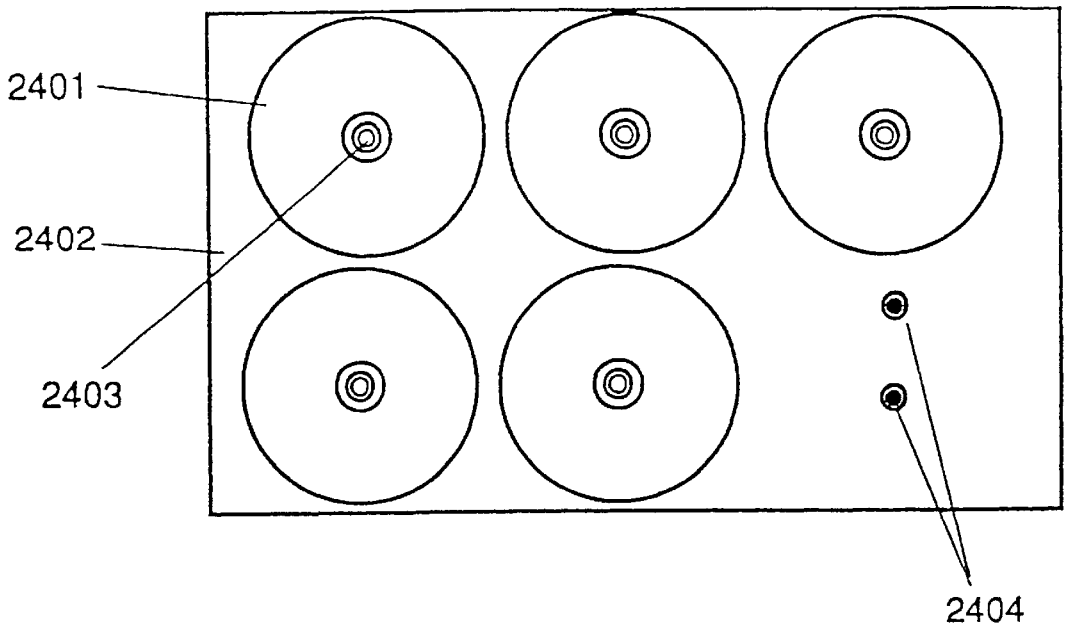
FIG. 24A PRIOR ART
FIG. 24A is a top view of a conventional dielectric notch filter.
Figure 24B:
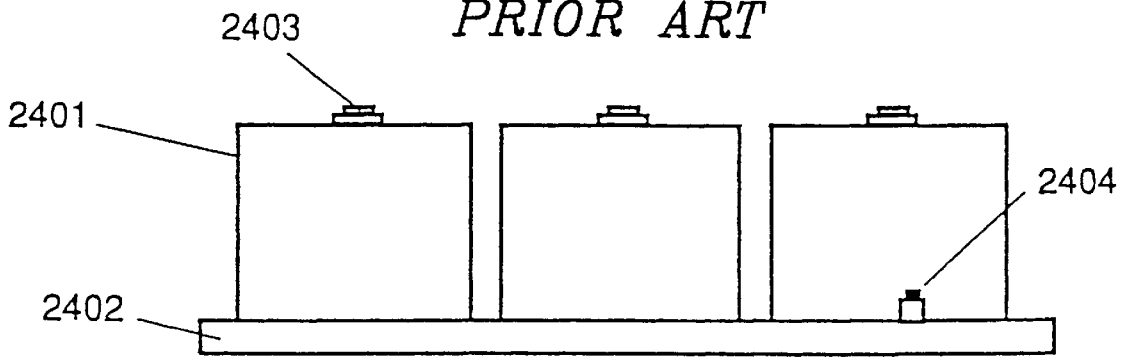
FIG. 24B PRIOR ART
FIG. 24B is a side view of the conventional dielectric notch filter shown in FIG. 24A.
Figure 25:
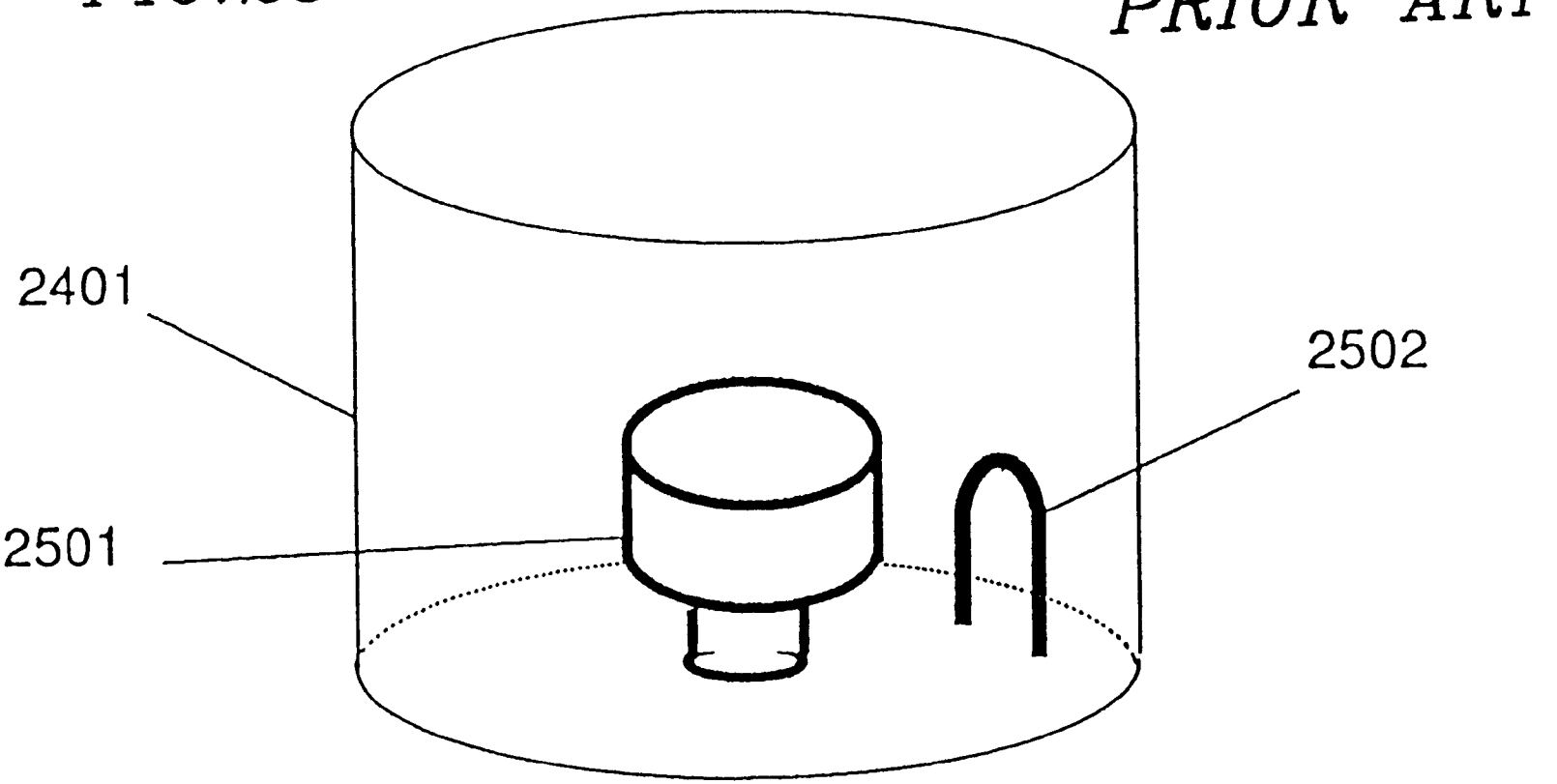
FIG. 25 PRIOR ART
FIG. 25 is a view showing the inside construction of the conventional dielectric resonator.
Figure 26:
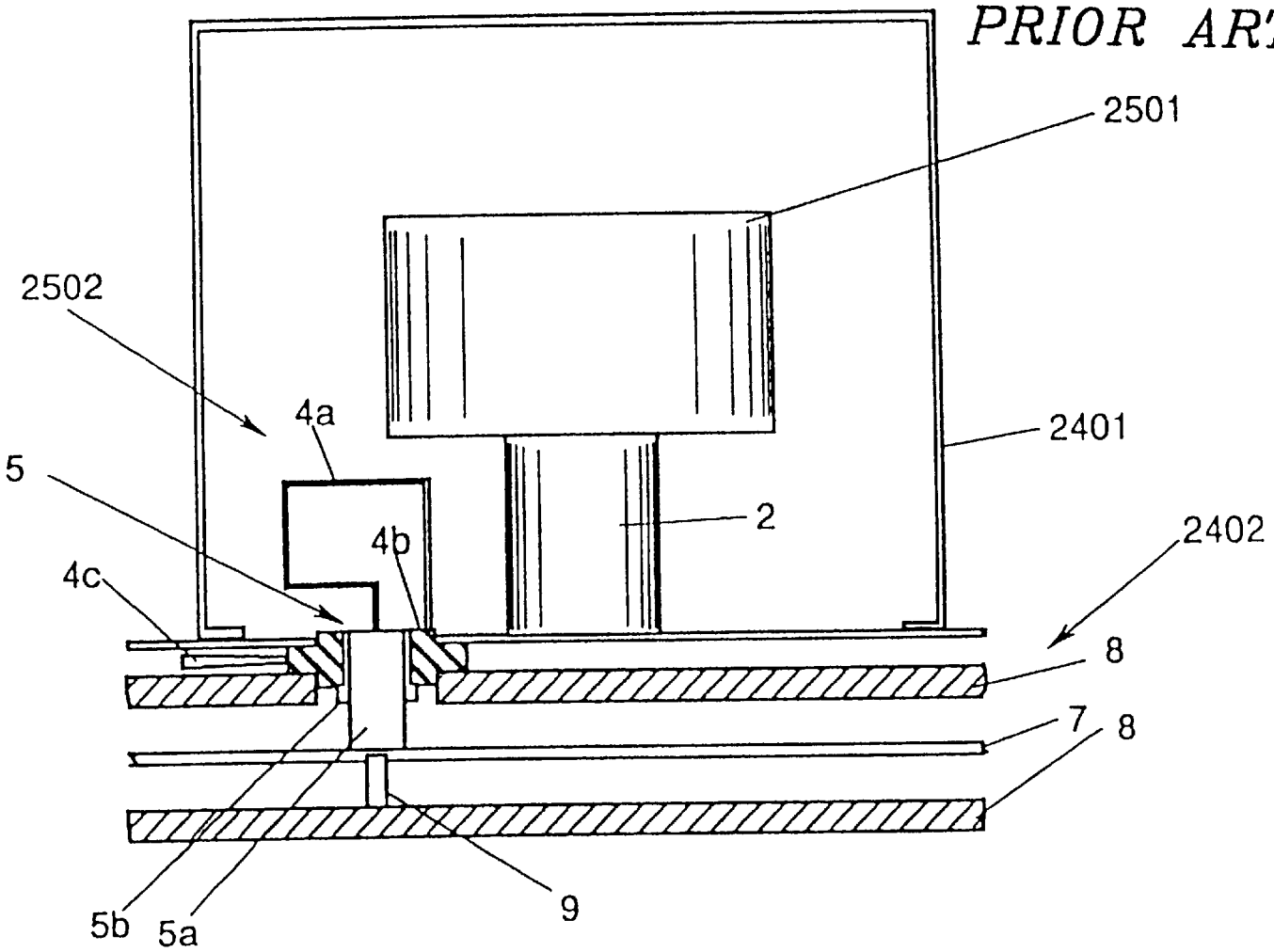
FIG. 26 PRIOR ART
FIG. 26 is a view of an electromagnetic coupling mechanism of a conventional dielectric resonator in detail.

Herein, Qext1 to Qext5 are external Q of the dielectric resonators shown in FIGS. 2 and 3. In FIGS. 2 and 3, the external Q's of the dielectric resonators are sequentially referred to as Qext1, Qext2, Qext3, Qext4, and Qext5 from the left side of the figures. As actually measured values of the characteristics of the notch filter having the above-described construction, the transmission characteristic (S21) and the reflection characteristic (S11) are shown in FIGS. 23A and 23B, respectively. When a notch filter is constructed in the above-described manner, the equal ripple characteristics in the band can be obtained in the pass characteristics, and poles can be generate in the vicinity of the band in the reflection characteristics (i.e., dips between the markers 1 and 2 and between the markers 3 and 4 in FIG. 23B). As a result, steep notch filter characteristics can be obtained.

In summary, the following is the method for obtaining steep notch filter characteristics when five stages of resonators are used. As shown in Expressions (3) and (4), the resonance frequency of the first-stage resonator is set to be the center frequency of the filter band, the resonance frequency of the second-stage resonator is set to be higher than the center frequency, the resonance frequency of the fourth-stage resonator is set to be much higher, the resonance frequency of the fifth-stage resonator is set to be lower than the center frequency, and the resonance frequency of the third-stage resonator is set to be much lower. In addition, the electrical lengths of the transmission lines between the first-stage and the second-stage resonators and between the fourth-stage and the fifth-stage resonators are set to be larger than an odd-integer multiple of λ/4 by λ/8 at the maximum, and the electrical length of the transmission lines between the second-stage and the third-stage resonators and between the third-stage and the fourth-stage resonators are set to be smaller than an odd-integer multiple of λ/4 by λ/8 at the maximum.

According to this example, in the transmission line 108 included in the filter, segments (E2 and E3) constituting inverters having a shorter electrical length and segments (E1 and E4) constituting inverters having a longer electrical length are arranged symmetrically. That is, the transmission line 108 is positioned in the center portion of the whole filter construction, and positioned substantially symmetrically. There is no case where one side portion is extremely long or short. This is convenient for connecting the transmission line 108 to the coupling loop 107 by the coupling adjusting line 106 having an average length (about 60 mm), and for adjusting the degree of coupling. If one portion of the transmission line 108 which constitutes an inverter is extremely longer, it is physically impossible to connect the transmission line 108 to the coupling loop 107 by the coupling adjusting line 106 having an average length, and it is difficult to vary the degree of coupling by adjusting the length of the coupling adjusting line 106. In this example, instead of the coupling loop, a coupling probe can be used. In such a case, the same effects can be obtained.

According to the invention, it is possible to provide a method for adjusting the degree of electromagnetic coupling in a dielectric resonator having a smaller number of components and having improved mechanical reliability.

Moreover, it is possible to realize a dielectric resonator having a simplified construction and having ideal impedance characteristics, and a dielectric notch filter can be easily designed and constructed.

Moreover, it is possible to attain a method for supporting a dielectric block in a mechanically as well as electrically improved manner using a smaller number of components.

Moreover, it is possible to obtain a compact metal cavity having a higher value of Q.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A dielectric resonator comprising:

a cavity having a first threaded hole;

a dielectric block provided in the cavity;

a coupling device coupled with an electromagnetic field produced in the cavity;

a frequency tuning member having a screw portion which is spirally engaged with the first threaded hole of the cavity, a distance between the dielectric block and the frequency tuning member being changed by rotating the frequency tuning member, for tuning a resonance frequency of the cavity depending on the distance; and fixing means for fixing a relative positional relationship between the frequency tuning member and the cavity, wherein the fixing means prevents the frequency tuning member from rotating due to a frictional force caused between the first threaded hole of the cavity and the screw portion of the frequency tuning member, the fixing means including a lock nut having a second threaded hole which is spirally engaged with screw portion of the frequency tuning member.

2. A dielectric resonator comprising:

a cavity having a first threaded hole;

a dielectric block provided in the cavity;

a coupling device coupled with an electromagnetic field produced in the cavity;

a frequency tuning member having a screw portion which is spirally engaged with the first threaded hole of the cavity, a distance between the dielectric block and the frequency tuning member being changed by rotating the frequency tuning member, for tuning a resonance frequency of the cavity depending on the distance; and fixing means for fixing a relative positional relationship between the frequency tuning member and the cavity, wherein the fixing means prevents the frequency tuning member from rotating due to a frictional force caused between the first threaded hole of the cavity and the screw portion of the frequency member, and wherein the fixing means includes a lock nut and a fixing screw, the lock nut having a second threaded hole which is spirally engaged with the screw portion of the frequency tuning member and a through hole through which the fixing screw is passed, the cavity having a third threaded hole which is spirally engaged with the fixing screw, and the fixing means applies a force in a direction in which the lock nut and the cavity come closer to each other by tightening the fixing screw.

3. A dielectric resonator comprising:

a cavity having a first threaded hole;

a dielectric block provided in the cavity;

a coupling device coupled with an electromagnetic field produced in the cavity;

a frequency tuning member having a screw portion which is spirally engaged with the first threaded hole of the cavity, a distance between the dielectric block and the frequency tuning member being changed by rotating the frequency tuning member, for tuning a resonance frequency of the cavity depending on the distance;

fixing means for fixing a relative positional relationship between the frequency tuning member and the cavity, wherein the fixing means prevents the frequency tuning member from rotating due to a frictional force caused between the first threaded hole of the cavity and the screw portion of the frequency tuning member, and wherein the fixing means has a lock nut and a fixing srew, the lock nut having a second threaded hole which is spirally engaged with the screw portion of the frequency tuning member and a third threaded hole which is spirally engaged with the fixing screw, and the fixing means applies a force in a direction in which the lock nut and the cavity are moved away from each other by tightening the fixing screw.

* * * * *

UNITED STATES PATENT AND TRADEMARK OFFICE

CERTIFICATE OF CORRECTION

PATENT NO. : 6,414,572 B2 
DATED : July 2, 2002
INVENTOR(S) : Yuki Satoh, Masami Hatanaka, Toshio Ishizaki, Yuji Saka and Toshiaki Nakamura It is certified that error appears in the above-identified patent and that said Letters Patent is hereby corrected as shown below:

Column 18,
Line 4, -- the -- is inserted before "screw."

Column 19,
Line 23, -- tuning -- is inserted before "member."

Column 20,
Line 21, "srew" should be -- screw --.

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,414,572 B2 
DATED : July 2, 2002
INVENTOR(S) : Yuki Satoh, Masami Hatanaka, Toshio Ishizaki, Yuji Saka and Toshiaki Nakamura It is certified that error appears in the above-identified patent and that said Letters Patent is hereby corrected as shown below:

Column 19,
Line 4, -- the -- is inserted before "screw."
Line 23, -- tuning -- is inserted before "member."

Column 20,
Line 21, "srew" should be -- screw --.

This certificate supersedes Certificate of Correction issued November 12, 2002.

Signed and Sealed this

Twenty-fifth Day of November, 2003

JAMES E. ROGAN
*Director of the United States Patent and Trademark Office*